US008496051B2

(12) United States Patent
Cejero et al.

(10) Patent No.: US 8,496,051 B2
(45) Date of Patent: Jul. 30, 2013

(54) STAGE TOOL APPARATUS AND METHOD

(75) Inventors: Gene Cejero, Edmonton (CA); Hoang The Truong, Edmonton (CA); Steve Giordano, Edmonton (CA)

(73) Assignee: Top-Co Cementing Products Inc., Weatherford, TX (US)

( * ) Notice: Subject to any disclaimer, the term of this patent is extended or adjusted under 35 U.S.C. 154(b) by 365 days.

(21) Appl. No.: 12/898,444

(22) Filed: Oct. 5, 2010

(65) Prior Publication Data

US 2011/0079381 A1 Apr. 7, 2011

Related U.S. Application Data

(60) Provisional application No. 61/249,537, filed on Oct. 7, 2009.

(51) Int. Cl.
*E21B 33/13* (2006.01)

(52) U.S. Cl.
USPC ..... 166/73; 29/897.3; 166/289

(58) Field of Classification Search
USPC ..... 166/289, 73; 29/897.3
See application file for complete search history.

(56) References Cited

U.S. PATENT DOCUMENTS

| | | | | | |
|---|---|---|---|---|---|
| 3,485,298 | A | * | 12/1969 | Kisling | 166/331 |
| 3,789,926 | A | * | 2/1974 | Henley et al. | 166/318 |
| 4,260,017 | A | * | 4/1981 | Nelson et al. | 166/154 |
| 4,487,263 | A | | 12/1984 | Jani | |
| 4,674,569 | A | * | 6/1987 | Revils et al. | 166/154 |
| 4,751,967 | A | * | 6/1988 | Blandford et al. | 166/330 |
| 5,368,098 | A | * | 11/1994 | Blizzard et al. | 166/100 |
| 6,250,618 | B1 | | 6/2001 | Greenhill | |
| 6,279,659 | B1 | | 8/2001 | Brunet | |
| 2007/0267200 | A1 | | 11/2007 | Jackson et al. | |

OTHER PUBLICATIONS

International Search Report, issued Nov. 26, 2010, by the ISA/US, regarding PCT International Application No. PCT/US2010/051612.
Written Opinion, issued Nov. 26, 2010, by the ISA/US, regarding PCT International Application No. PCT/US2010/051612.

* cited by examiner

*Primary Examiner* — Daniel P Stephenson
(74) *Attorney, Agent, or Firm* — Haynes and Boone, LLP

(57) ABSTRACT

A stage tool apparatus is described. In several exemplary embodiments, the stage tool apparatus is part of tubular string or casing positioned within a preexisting structure such as, for example, a wellbore.

41 Claims, 18 Drawing Sheets

STAGE TOOL APPARATUS AND METHOD

CROSS REFERENCE TO RELATED APPLICATION

This application claims the benefit of the filing date of U.S. provisional patent application No. 61/249,537, filed Oct. 7, 2009, the entire disclosure of which is incorporated herein by reference.

BACKGROUND

This disclosure relates in general to oil and gas exploration and production operations, and in particular to supporting a casing that extends within a wellbore, and isolating one or more formations through which the wellbore extends, to facilitate oil and gas exploration and production operations.

DETAILED DESCRIPTION

Figure 1:
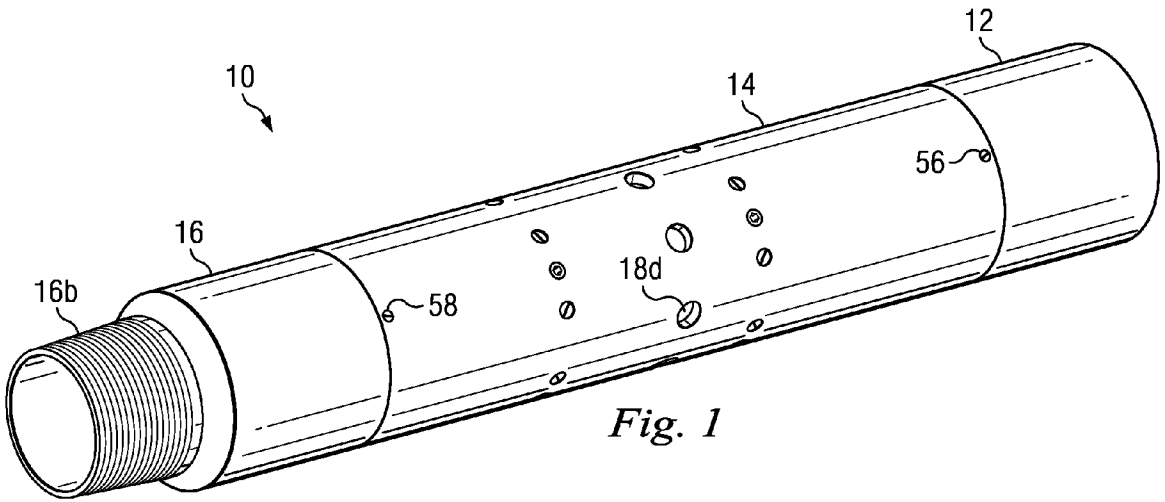
FIG. 1 is a perspective view of a stage tool apparatus according to an exemplary embodiment, the stage tool apparatus including a box sub, a body assembly and a pin sub.
Figure 2:
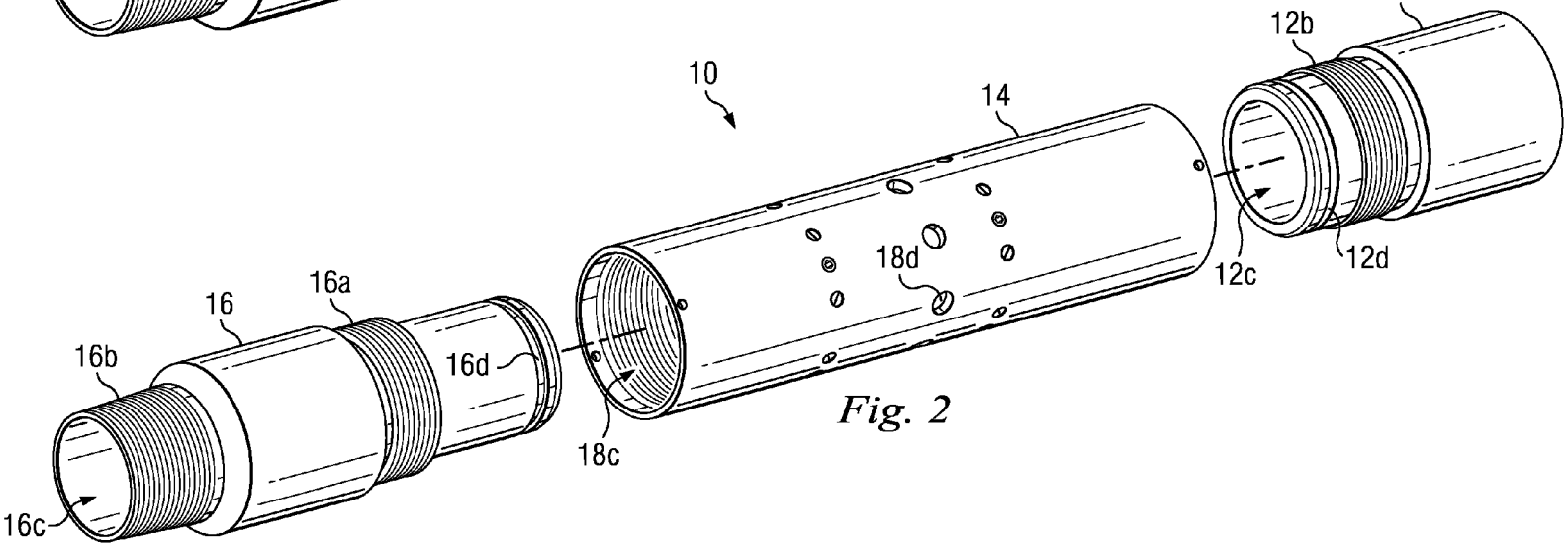
FIG. 2 is a partially exploded view of the stage tool apparatus of FIG. 1 according to an exemplary embodiment.
Figure 3:
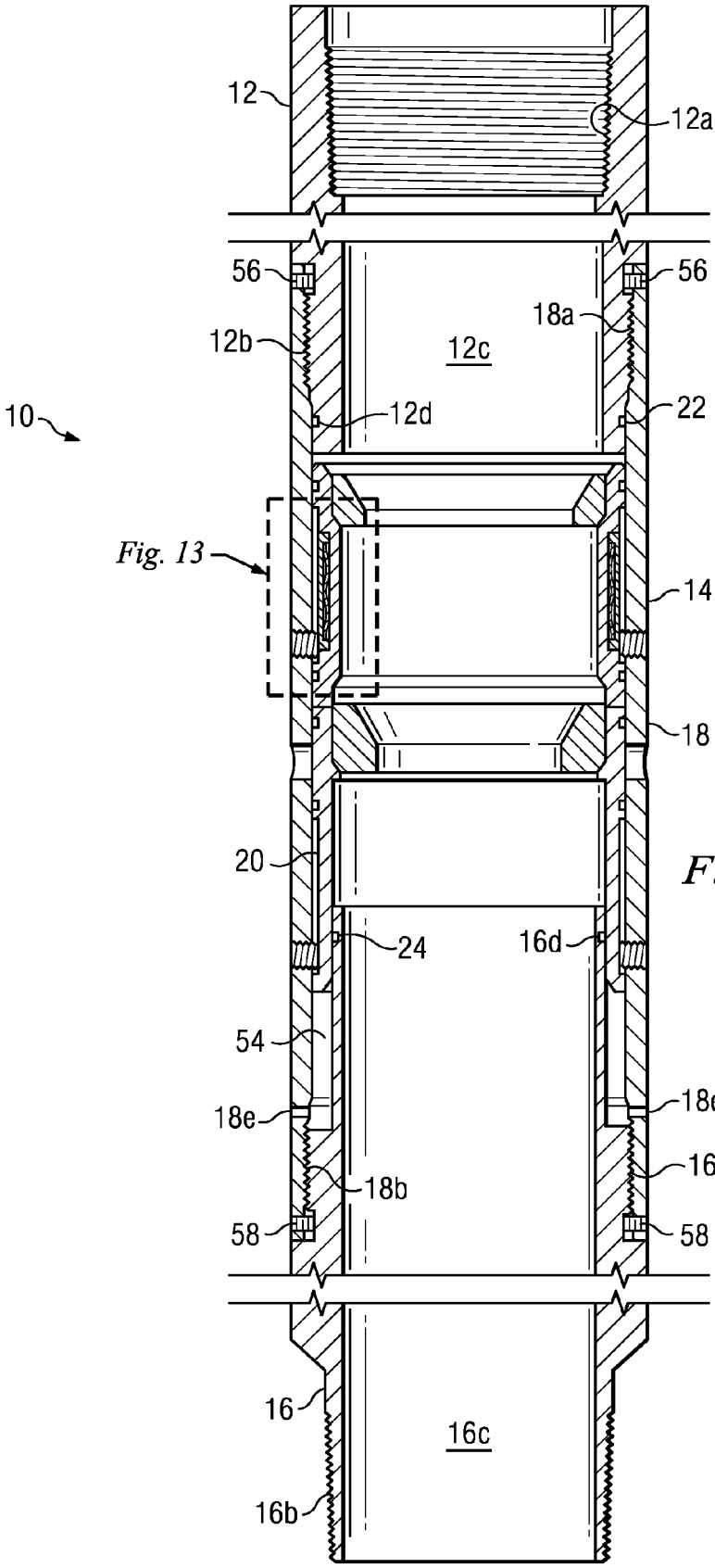
FIG. 3 is a sectional view of the stage tool apparatus of FIG. 1 according to an exemplary embodiment.
Figure 4:
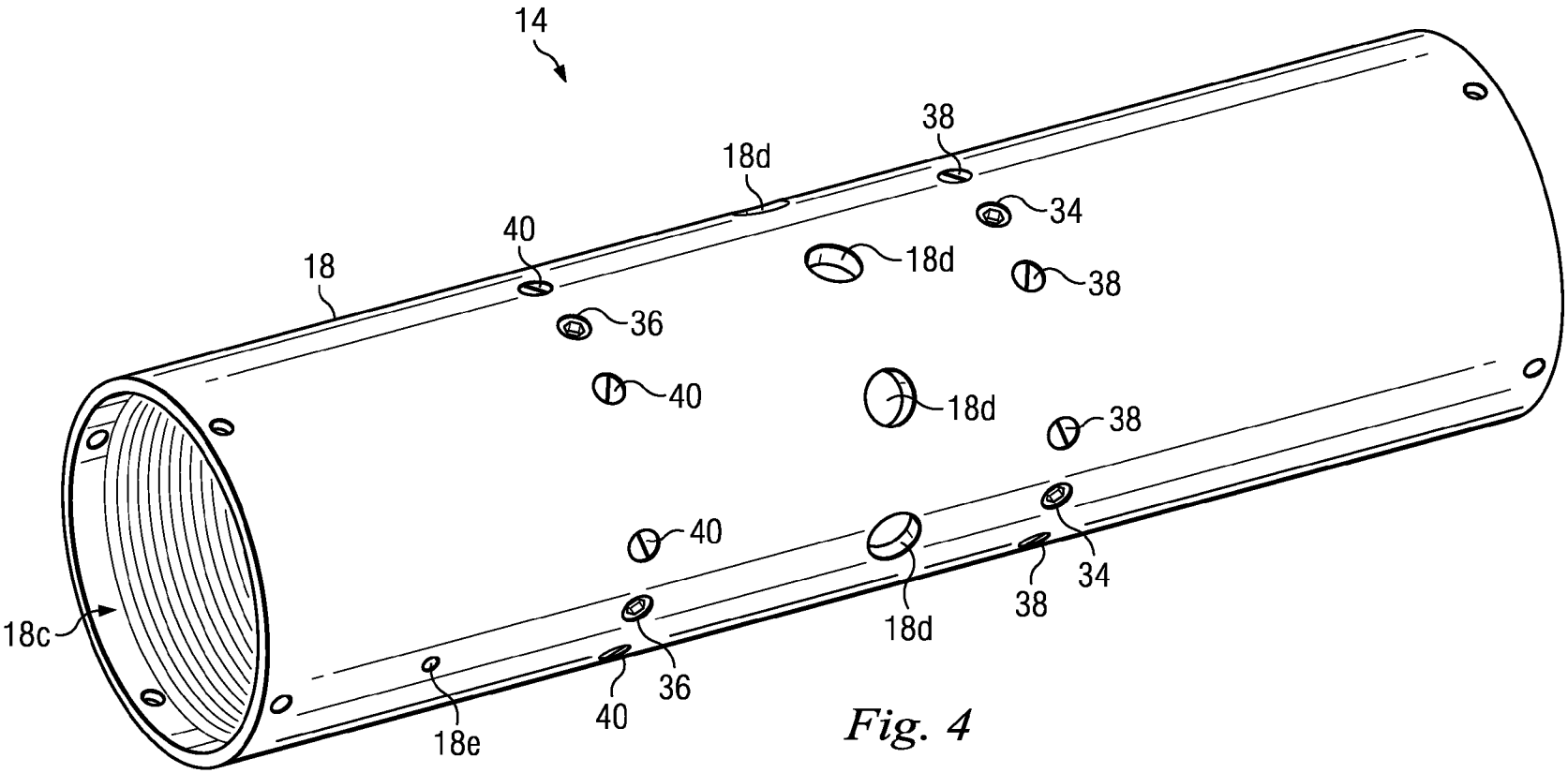
FIG. 4 is a perspective view of the body assembly of FIG. 1 according to an exemplary embodiment, the body assembly including an outer sleeve and a plurality of components engaged therewith or disposed therein.

In an exemplary embodiment, as illustrated in FIGS. 1-3, a stage tool apparatus is generally referred to by the reference numeral 10 and includes a box sub 12, a body assembly 14, and a pin sub 16. The box sub 12 includes an internal threaded connection 12*a* at one of its end portions, and an external threaded connection 12*b* that is axially spaced between the internal threaded connection 12*a* and the other of its end portions. The box sub 12 defines an internal passage 12*c*.

The body assembly 14 includes an outer tubular member, such as an outer sleeve 18, and a plurality of components 20 engaged therewith or disposed therein, which components will be described in greater detail below. The outer sleeve 18 includes an internal threaded connection 18*a* at one of its end portions and an internal threaded connection 18*b* at the other of its end portions. The internal threaded connection 18*a* is coupled to the external threaded connection 12*b* of the box sub 12, thereby coupling the box sub 12 to the body assembly 14. The outer sleeve 18 defines an internal passage 18*c*. A sealing element, such as an o-ring 22, extends in an annular channel 12*d* formed in the outside surface of the box sub 12, the o-ring 22 sealingly engaging the inside surface of the outer sleeve 18.

The pin sub 16 includes an external threaded connection 16*a* at one end portion, which is coupled to the internal threaded connection 18*b* of the outer sleeve 18 of the body assembly 14, thereby coupling the pin sub 16 to the body assembly 14. The pin sub 16 further includes an external threaded connection 16*b* at the other end portion that is distal to the body assembly 14. The pin sub 16 defines an internal passage 16*c*. As shown in FIG. 3, a sealing element, such as an o-ring 24, extends in an annular channel 16*d* formed in the outside surface of the pin sub 16.

In an exemplary embodiment, as illustrated in FIGS. 4-9 with continuing reference to FIGS. 1-3, the outer sleeve 18 further includes a plurality of circumferentially-spaced flow ports 18*d*, each of which extends radially through the outer sleeve 18, and a plurality of circumferentially-spaced ports 18*e* spaced axially from the plurality of ports 18*d*, with each of the ports 18*e* also extending radially through the outer sleeve 18.

As noted above, the body assembly 14 includes a plurality of components 20 engaged with the outer sleeve 18 or disposed therein. The plurality of components 20 includes an upper tubular member such as an upper sleeve 26, a lower tubular member such as a lower sleeve 28, an upper seat 30, a lower seat 32, a plurality of components such as fasteners 34, a plurality of components such as fasteners 36, a plurality of shear screws 38, a plurality of shear screws 40, a plurality of springs 42, a plurality of lock keys 44, and sealing elements such as o-rings 46, 48, 50 and 52.

The upper sleeve 26 includes a plurality of axially-extending channels 26*a* formed in its outside surface, a circumferentially-extending shoulder 26*b* formed in its inside surface, and diametrically opposite arcuate notches 26*c* and 26*d* formed in one of its end portions. Each of the channels 26*a* includes an axially-extending channel or recess 26*aa* formed in a surface of the upper sleeve 26 defined by the channel 26*a*. The upper sleeve 26 defines an internal passage 26*e*.

The lower sleeve 28 includes a plurality of axially-extending channels 28*a* formed in its outside surface, a circumferentially-extending shoulder 28*b* formed in its inside surface, an arcuate notch 28*c* formed in a first end portion of the lower sleeve 28, and an arcuate notch (not shown) formed in the first end portion of the lower sleeve 28 and diametrically opposite the arcuate notch 28*c*. The lower sleeve 28 defines an internal passage 28*e*.

Figure 10:
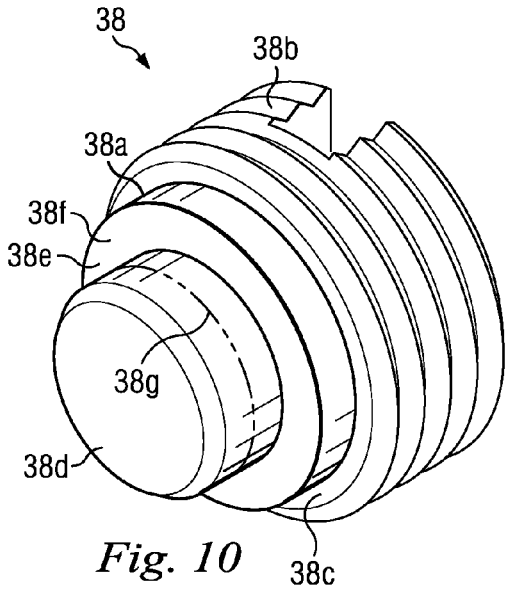
FIG. 10 is a perspective view of a shear screw according to an exemplary embodiment, the shear screw being one of the components shown in FIG. 6.

In an exemplary embodiment, as illustrated in FIG. 10 with continuing reference to FIGS. 1-9, each of the shear screws 38 includes a cylindrical body 38*a*, an external threaded connection 38*b* at one end portion of the cylindrical body 38*a*, a shoulder 38*c* formed in the cylindrical body 38*a* and adjacent the external threaded connection 38*b*, a generally cylindrical shear portion 38*d* extending from the other end portion of the cylindrical body 38*a*, and a shoulder 38*e* adjacent the proximal end of the generally cylindrical shear portion 38*d*, the shoulder 38*e* defining a flat 38*f*. One or more shear planes 38*g* extend through the generally cylindrical shear portion 38*d*, and are offset from, and generally parallel to, the flat 38*f*. Each of the one or more shear planes 38*g* is adapted to define the location at which at least a portion of the generally cylindrical shear portion 38*d* shears off from the remainder of the shear screw 38, under conditions to be described below.

The shear screws 40 are identical to the shear screws 38. Each of the shear screws 40 includes features that are identical to the features of each of the shear screws 38. Reference numerals used to refer to the features of the shear screws 40 that are identical to the features of the shear screws 38 will correspond to the reference numerals used to refer to the features of the shear screws 38 except that the prefix for the reference numerals used to refer to the features of the shear screws 38, that is, 38, will be replaced by the prefix of the shear screws 40, that is, 40.

Figure 11:
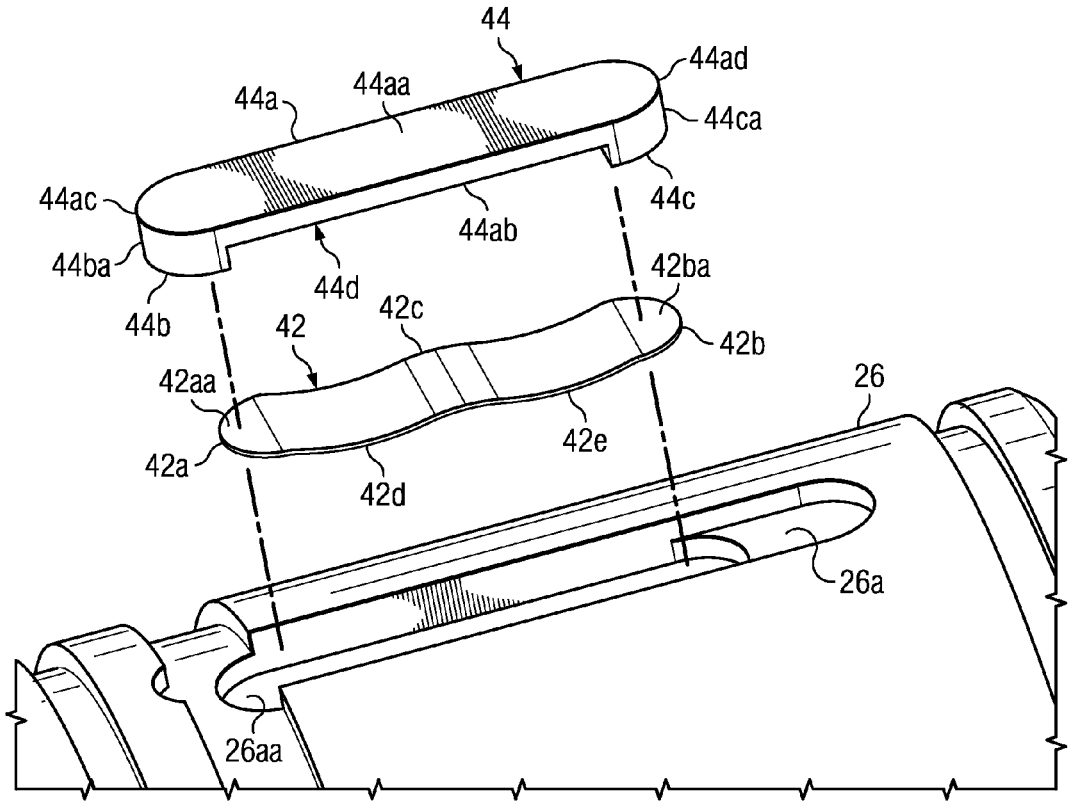
FIG. 11 is an enlarged view of a portion of FIG. 8 and illustrates a lock key and a spring according to respective exemplary embodiments.
Figure 12:
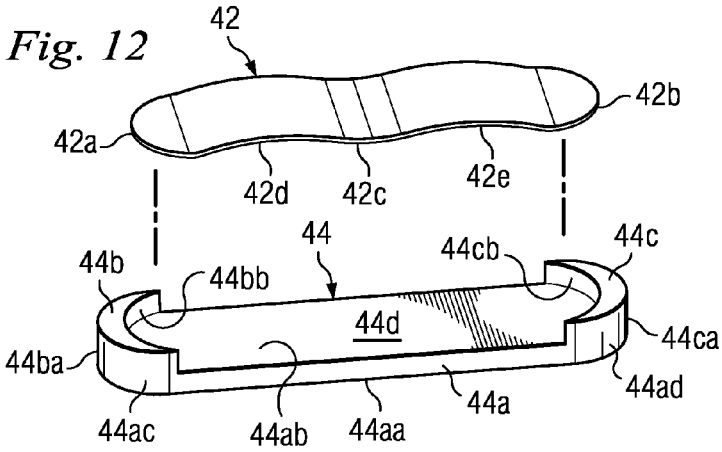
FIG. 12 is a perspective view of the lock key and the spring of FIG. 11.

In an exemplary embodiment, as illustrated in FIGS. 11 and 12 with continuing reference to FIGS. 1-10, each of the springs 42 includes opposing curved end portions 42*a* and 42*b* that define generally flat surfaces 42*aa* and 42*ba*, respectively, and a middle portion 42*c*. An arcuate portion 42*d* extends between the curved end portion 42*a* and the middle portion 42*c*. An arcuate portion 42*e* extends between the curved end portion 42*b* and the middle portion 42*c*.

Each of the lock keys 44 includes a bar member 44*a* defining sides 44*ac* and 44*ab* spaced in a parallel relation, and having opposing curved end portions 44*ac* and 44*ad*. Protrusions 44*b* and 44*c* extend from the side 44*ab* and include curved outer surfaces 44*ba* and 44*ca*, respectively, which are flush with the extents of the curved end portions 44*ac* and 44*ad*, respectively. The protrusions 44*b* and 44*c* further include facing curved inner surfaces 44*bb* and 44*cb*, respectively. An axially-extending region 44*d* is defined by the side 44*cb* and the curved inner surfaces 44*bb* and 44*cb*.

In an exemplary embodiment with continuing reference to FIGS. 1-12, when the stage tool apparatus 10 is in an assembled condition as illustrated in FIGS. 1 and 3, the external threaded connection 12*b* of the box sub 12 is threadably engaged with the internal threaded connection 18*a* of the outer sleeve 18, thereby coupling the box sub 12 to the outer sleeve 18. The o-ring 22 extends in the annular channel 12*d* formed in the outside surface of the box sub 12, and sealingly engages the inside surface of the outer sleeve 18. The external threaded connection 16*a* of the pin sub 16 is threadably engaged with the internal threaded connection 18*b* of the outer sleeve 18, thereby coupling the pin sub 16 to the outer sleeve 18. The o-ring 24 extends in the annular channel 16*d* formed in the outside surface of the pin sub 16, and sealingly engages an inside surface of the outer sleeve 18.

An annular region 54 (FIG. 3) is defined between the inside surface of the outer sleeve 18 and an outside surface of the end portion of the pin sub 16 that extends within the internal passage 18*c* of the outer sleeve 18. The annular region 54 is in fluid communication with the outside of the outer sleeve 18 and thus the apparatus 10 via the ports 18*e*. At least the lower end portion of the lower sleeve 28 extends within the annular region 54. A plurality of fasteners 56 extend through the outer sleeve 18 and into an annular channel formed in the outside surface of the box sub 12, thereby locking the box sub 12 to the outer sleeve 18. A plurality of fasteners 58 extend through the outer sleeve 18 and into an annular channel formed in the outside surface of the pin sub 16, thereby locking the pin sub 16 to the outer sleeve 18.

Figure 6:
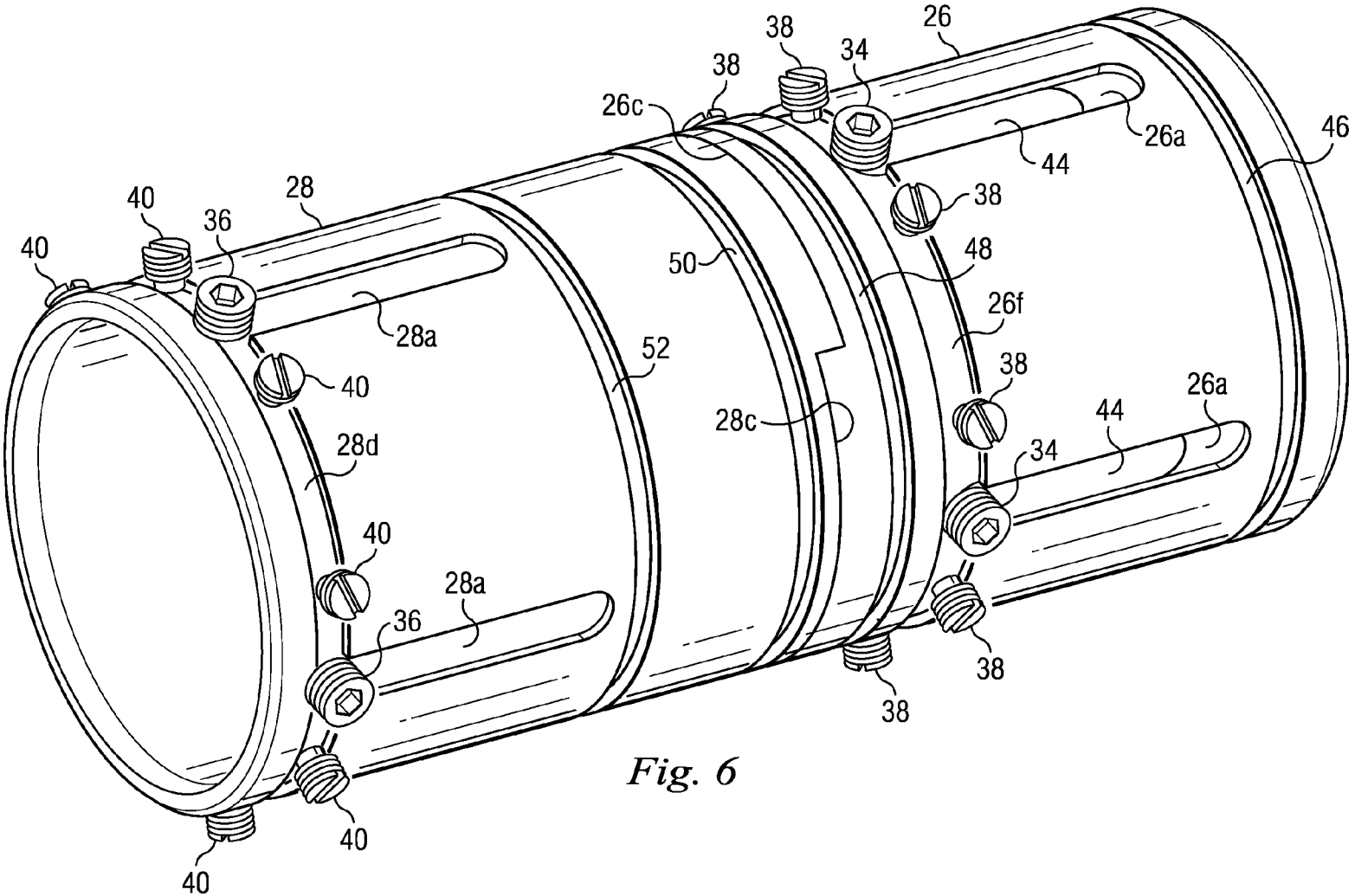
FIG. 6 is a perspective view of the plurality of components of FIGS. 4 and 5 according to an exemplary embodiment.
Figure 7:
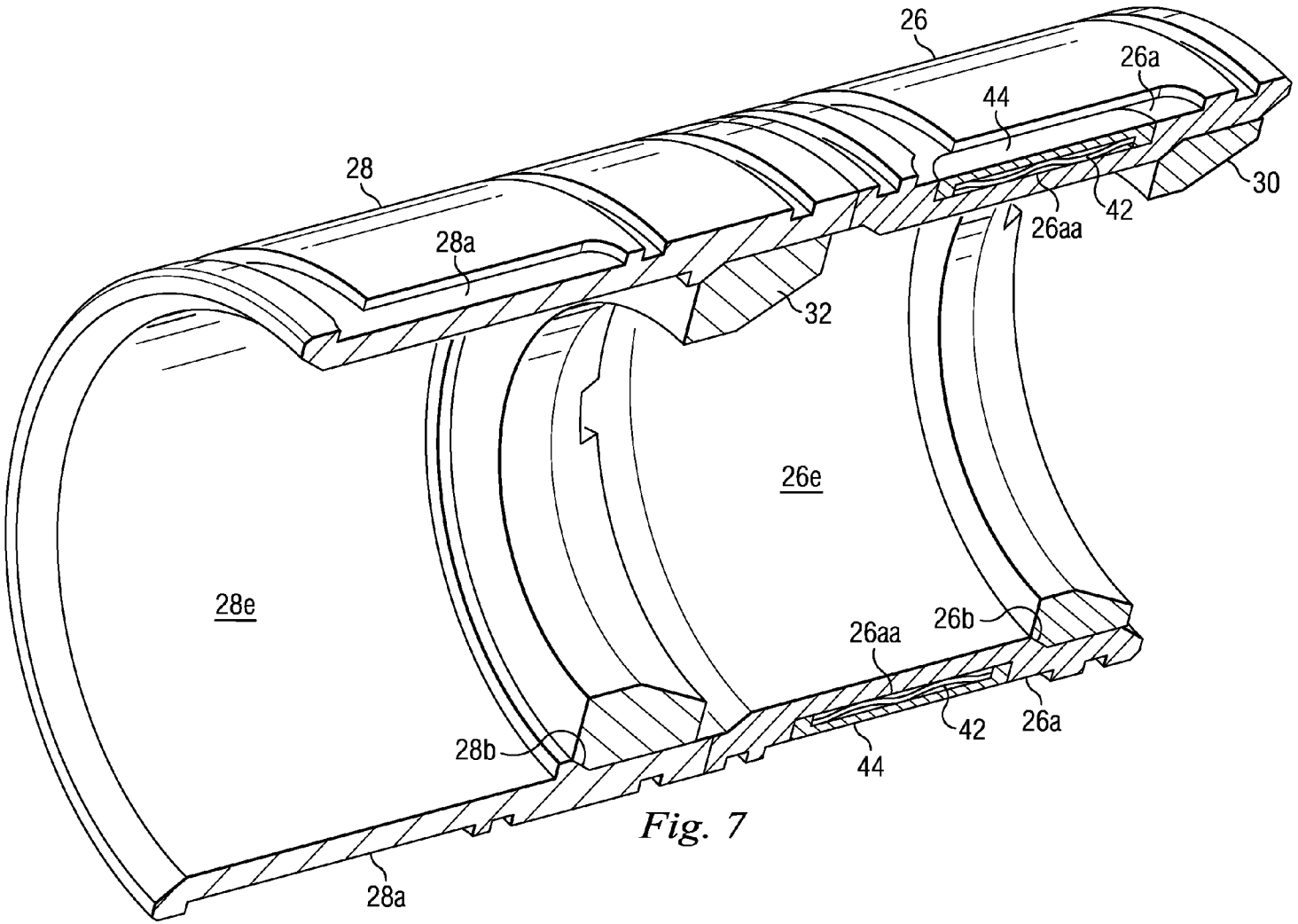
FIG. 7 is a perspective view of a section of a portion of the plurality of components of FIGS. 4-6 according to an exemplary embodiment.
Figure 8:
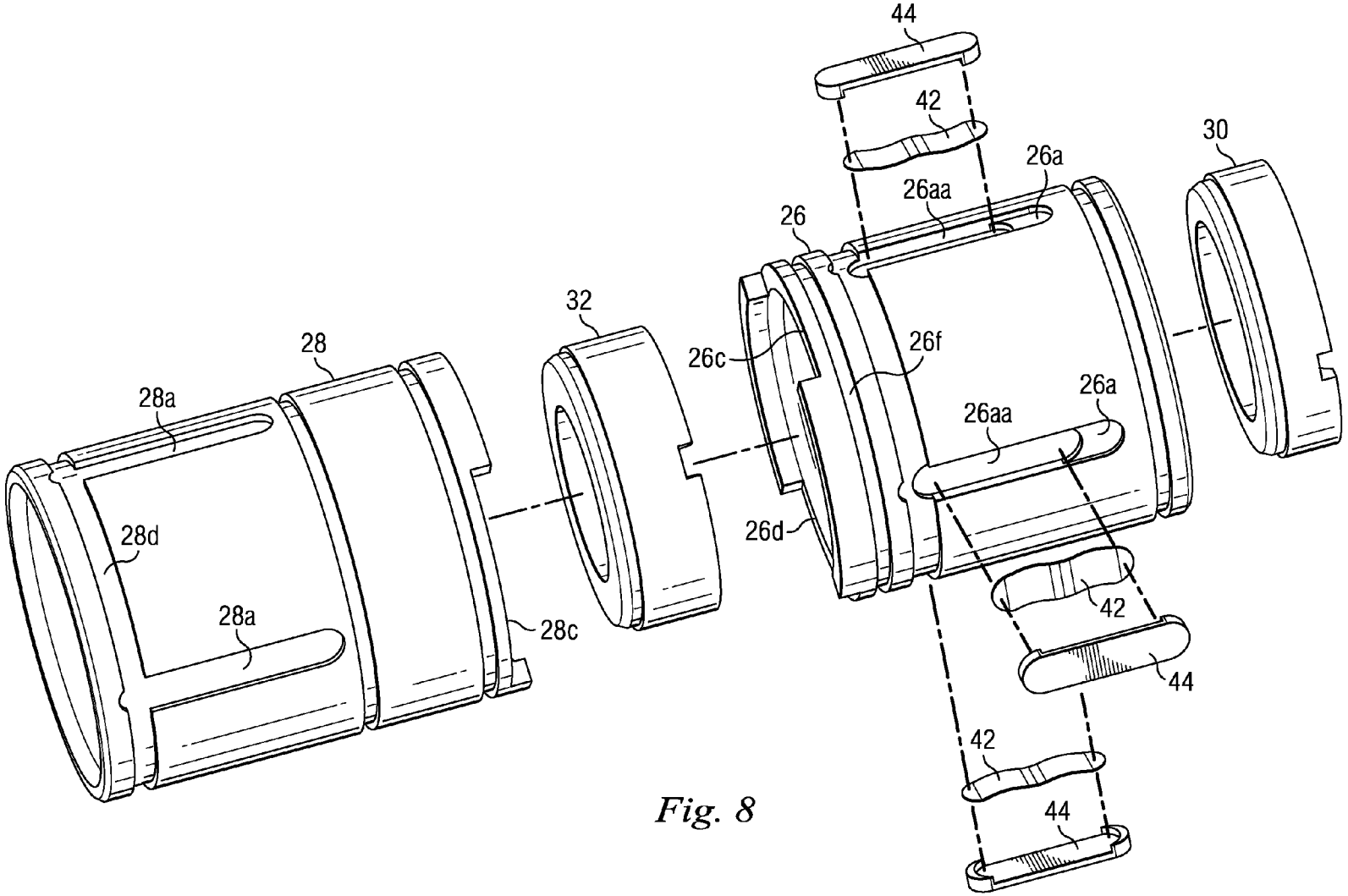
FIG. 8 is an exploded view of a portion of the plurality of components of FIGS. 4-7 according to an exemplary embodiment.
Figure 9:
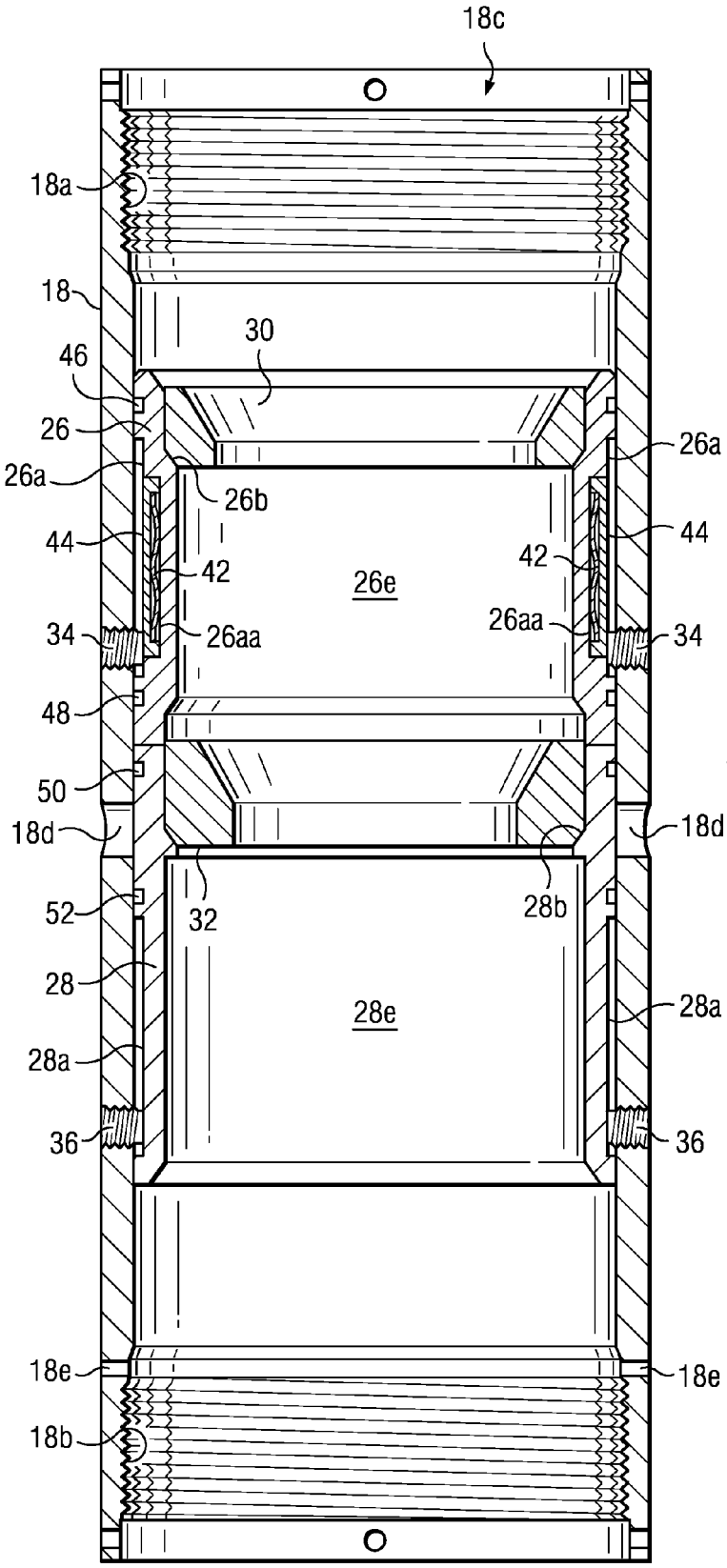
FIG. 9 is a sectional view of the body assembly of FIGS. 4 and 5 according to an exemplary embodiment.

The upper sleeve 26 extends within the internal passage 18*c* of the outer sleeve 18. The lower sleeve 28 also extends within the internal passage 18*c* of the outer sleeve 18. Within the internal passage 18*c*, the upper sleeve 26 is engaged with the lower sleeve 28 so that lower end portions of the upper sleeve 26 defined by the arcuate notches 26*c* and 26*d* are interposed between upper end portions of the lower sleeve 28 defined in part by the arcuate notch 28*c*, as shown in FIGS. 6 and 7. In an exemplary embodiment, axial gaps are defined between axially-facing end surfaces defined by the interposed lower end portions of the upper sleeve 26 and corresponding axially-facing end surfaces defined by the interposed upper end portions of the lower sleeve 28; in an exemplary embodiment, grease is disposed in the axial gaps to eliminate any metal-to-metal surface seal.

The upper seat 30 is disposed within the upper sleeve 26, engaging the shoulder 26*b* of the upper sleeve 26. The o-ring 46 sealingly engages the inside surface of the outer sleeve 18, and the o-ring 48, which is axially spaced from the o-ring 46, also sealingly engages the inside surface of the outer sleeve 18. As a result, the channels 26*a* and thus the recesses 26*aa* are fluidically isolated from the internal passages 12*c*, 16*c*, 18*c*, 26*e* and 28*e*. The shear screws 38 extend through the outer sleeve 18 and into an opening, such as an annular channel 26*f*, formed in the outside surface of the upper sleeve 26, thereby generally preventing relative axial movement between the upper sleeve 26 and the outer sleeve 18.

Figure 5:
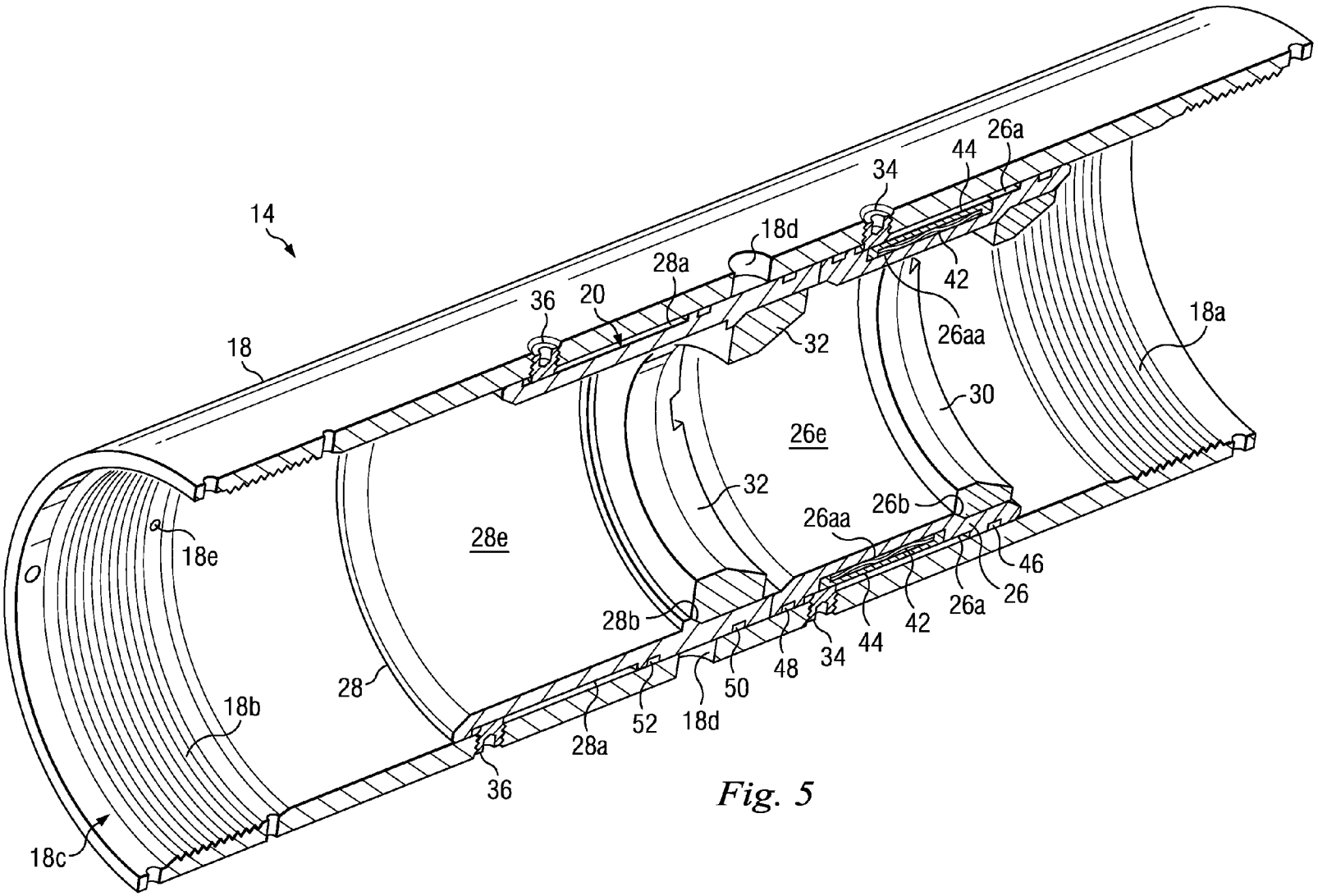
FIG. 5 is a perspective view of a section of the body assembly of FIG. 4 according to an exemplary embodiment, and depicts the outer sleeve and at least a portion of the plurality of components engaged therewith or disposed therein.

The lower seat 32 is disposed within the lower sleeve 28, engaging the shoulder 28*b* of the lower sleeve 28. Each of the fasteners 36 is coupled to the outer sleeve 18 and extends radially from the outer sleeve 18 and into a respective one of the channels 28*a* of the lower sleeve 28, thereby preventing or at least resisting relative rotation between the lower sleeve 28 and the outer sleeve 18. As shown in FIG. 5, the lower sleeve 28 blocks the ports 18*d*, the o-ring 50 sealingly engages the inside surface of the outer sleeve 18, and the o-ring 52, which is axially spaced from the o-ring 50, sealingly engages the inside surface of the outer sleeve 18. As a result, the ports 18*d* are fluidically isolated from the internal passages 12*c*, 16*c*, 18*c*, 26*e* and 28*e*. The shear screws 40 extend through the outer sleeve 18 and into an opening, such as an annular channel 28*d*, formed in the outside surface of the lower sleeve 28, thereby generally preventing or at least resisting relative axial movement between the lower sleeve 28 and the outer sleeve 18.

Figure 13:
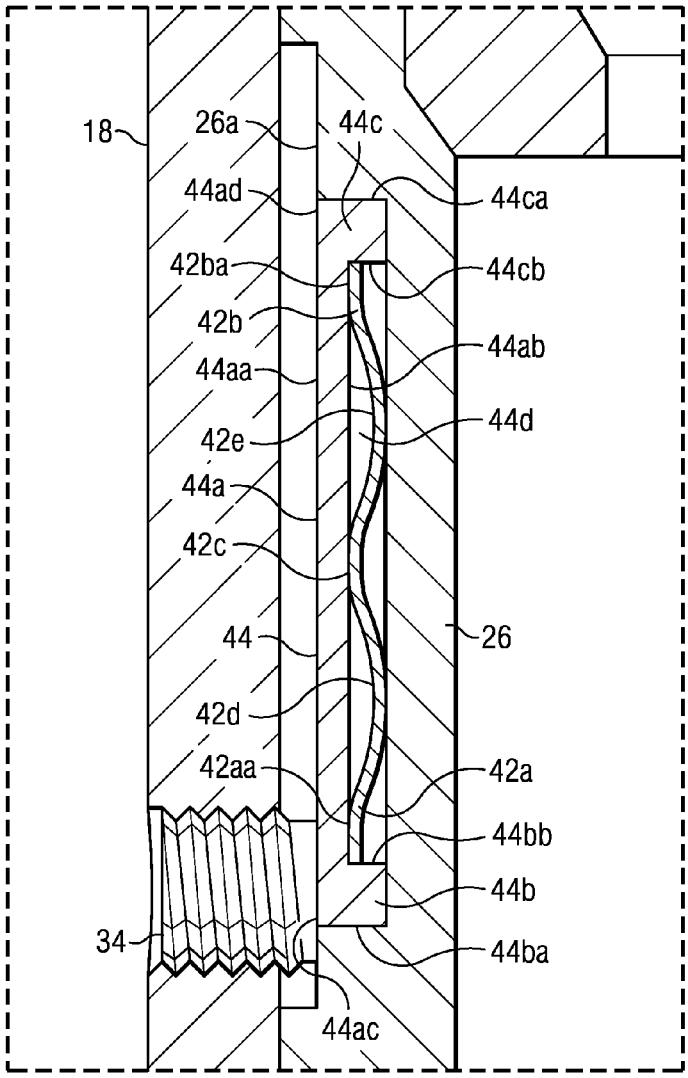
FIG. 13 is an enlarged view of a portion of FIG. 3.

In an exemplary embodiment, as illustrated in FIG. 13 with continuing reference to FIGS. 1-12, when the stage tool apparatus 10 is in an assembled condition as illustrated in FIGS. 1 and 3, each of the springs 42 is disposed in a respective one of the recesses 26*aa* of the upper sleeve 26. Each of the lock keys 44 is disposed in a respective one of the recesses 26*aa* so that the respective spring 42 is disposed radially between the upper sleeve 26 and the lock key 44, and is biased against the lock key 44 in an outwardly radial direction. At least one of the arcuate portions 42*d* and 42*e* of each spring 42 engages the vertically-extending surface of the sleeve 26 defined by the corresponding recess 26*aa*. For each of the springs 42 and its corresponding lock key 44, the opposing curved end portions 42*a* and 42*b* engage or nearly engage the curved inner surfaces 44*bb* and 44*cb*, respectively, the surfaces 42*aa* and 42*ba* engage the side 44*ab*, and the spring 42 extends within the region 44*d* of the corresponding lock key 44. Each of the fasteners 34 is coupled to the outer sleeve 18 and extends radially from the outer sleeve 18 and into a respective one of the channels 26*a* of the upper sleeve 26, thereby preventing or at least resisting relative rotation between the upper sleeve 26 and the outer sleeve 18. As shown in FIG. 13 and also in FIG. 5, each of the fasteners 34 engages at least the side 44*aa* of the corresponding lock key 44 at or proximate the curved end portion 44*ac*, thereby energizing the corresponding spring 42. More particularly, as a result of the engagements of the fasteners 34 with the sides 44*aa* of the respective lock keys 44, at least one of the arcuate portions 42*d* and 42*e* of each of the springs 42 is compressed between the vertically-extending surface of the sleeve 26 defined by the corresponding recess 26*aa* and the side 44*ab* of the corresponding lock key 44, thereby energizing the at least one of the arcuate portions 42*d* and 42*e* so that each of the springs 42 is energized and urges the corresponding lock key 44 radially outwards and out of the corresponding recess 26*aa*. However, the corresponding fastener 34 that is engaged with the side 44*aa* of the corresponding lock key 44 prevents or at least resists at least a portion of the lock key 44 from being pushed radially outwardly by the corresponding spring 42.

Figure 14:
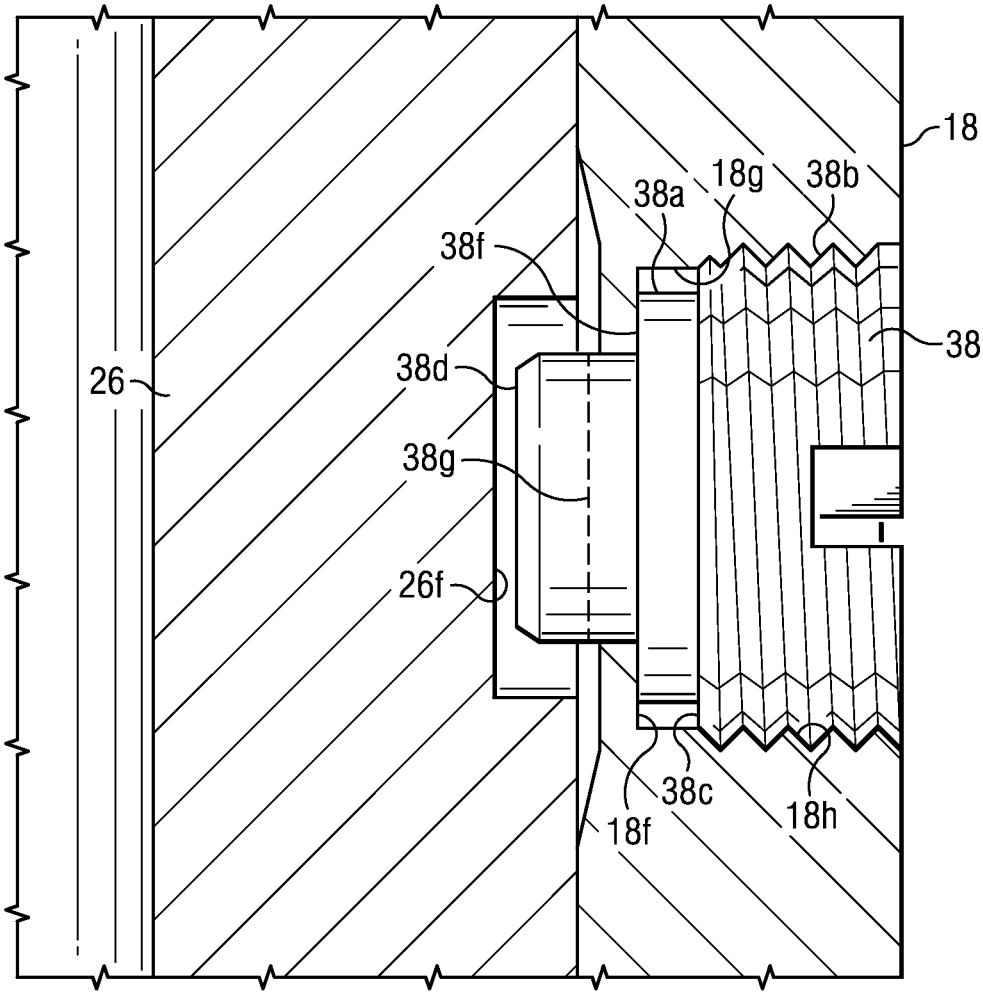
FIG. 14 is a partial sectional view of the shear screw of FIG. 10 extending through the outer sleeve of the body assembly of FIG. 4, according to an exemplary embodiment.

As noted above, the shear screws 38 extend through the outer sleeve 18 and into the annular channel 26*f* formed in the outside surface of the upper sleeve 26, thereby generally preventing or at least resisting relative axial movement between the upper sleeve 26 and the outer sleeve 18. In an exemplary embodiment, as illustrated in FIG. 14, each of the flats 38*f* engages a respective shoulder 18*f* of the outer sleeve 18 defined by, for example, a respective counterbore 18*g* in which the respective shear screw 38 is disposed, so that the shear screw 38 can be tightened up against the outer sleeve 18 for extra support, thereby preventing, or at least resisting, any twisting, slipping or stripping of the external threaded connection 38*b*. Each of the counterbores 18*g* includes an internal threaded connection 18*h* that is threadably engaged with the external threaded connection 38*b* of the respective shear screw 38. Likewise, as noted above, the shear screws 40 extend through the outer sleeve 18 and into the annular channel 28*d* formed in the outside surface of the lower sleeve 28, thereby generally preventing or at least resisting relative axial movement between the lower sleeve 28 and the outer sleeve 18. Each of the flats 40*f* engages a shoulder 18*i* (shown in FIG. 16*a*) of the outer sleeve 18 defined by, for example, a counterbore 18*j* (shown in FIG. 16*a*) in which the shear screw 40 is disposed, so that the shear screw 40 can be tightened up against the outer sleeve 18 for extra support, thereby preventing, or at least resisting, any twisting, slipping or stripping of the threaded connection 40*b*. Each of the counterbores 18*j* includes an internal threaded connection 18*k* (shown in FIG. 16*a*) that is threadably engaged with the external threaded connection 40*b* of the respective shear screw 40.

In operation, in an exemplary embodiment, the apparatus 10 is initially in its assembled condition described above and is part of a tubular string or casing. A threaded end of a tubular support member (not shown) that defines an internal passage may be coupled to the internal threaded connection 12*a* of the box sub 12 so that the internal passage of the tubular support member is in fluid communication with the internal passage 12*c* of the box sub 12, the internal passage 18*c* of the outer sleeve 18, the internal passage 26*e* of the upper sleeve 26, the internal passage 28*e* of the lower sleeve 28, and the internal passage 16*c* of the pin sub 16. Similarly, a threaded end of another tubular member (not shown) that defines an internal passage may be coupled to the external threaded connection 16*b* of the pin sub 16 so that the internal passage of the other tubular support member is in fluid communication with the internal passage 12*c* of the box sub 12, the internal passage 18*c* of the outer sleeve 18, the internal passage 26*e* of the upper sleeve 26, the internal passage 28*e* of the lower sleeve 28, and the internal passage 16*c* of the pin sub 16.

Figure 15:
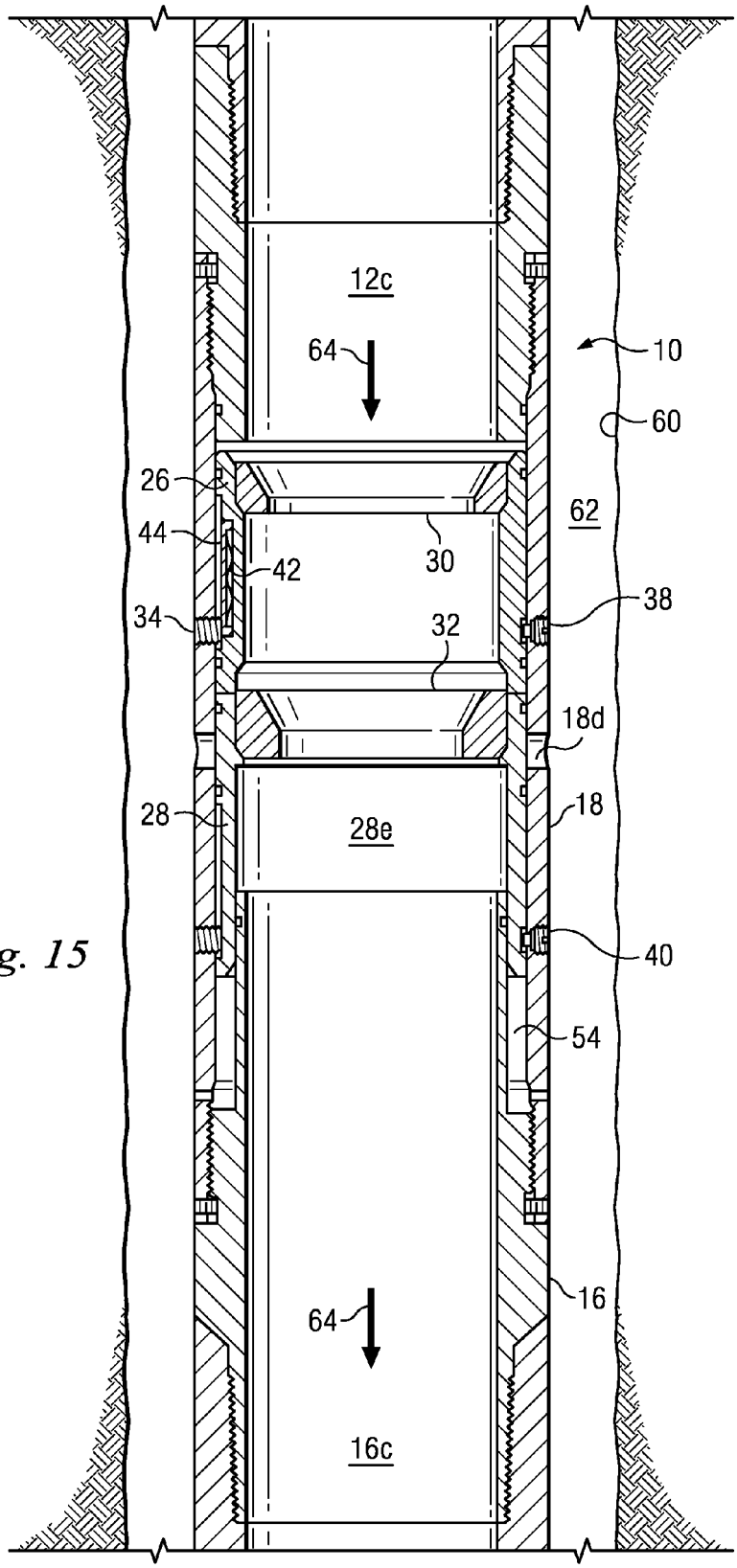
FIG. 15 is a partial sectional view of the stage tool apparatus of FIG. 1 extending within a wellbore and placed in an operational mode, according to an exemplary embodiment.

As illustrated in FIG. 15, the tubular string or casing of which the apparatus 10 is a part is positioned within a preexisting structure such as, for example, a wellbore 60 that traverses one or more subterranean formations, thereby defining an annular region 62 between the inside wall of the wellbore and the outside surface of the outer sleeve 18. As shown in FIG. 15, the apparatus 10 is in a neutral configuration, which generally corresponds to the assembled condition described above in which, inter alia, the lower sleeve 28 blocks the ports 18*d*, which are fluidically isolated from the internal passages 12*c*, 16*c*, 18*c*, 26*e* and 28*e*. As a result, the annular region 62 is fluidically isolated from the internal passages 12*c*, 16*c*, 18*c*, 26*e* and 28*e*.

In an exemplary embodiment, during or after the positioning of the apparatus 10 within the wellbore 60, fluidic materials 64 are injected into and circulated through the apparatus 10 via the internal passage 12*c*, the internal passage 18*c*, the internal passage 26*e*, the internal passage 28*e*, and the internal passage 16*c*. In an exemplary embodiment, the fluidic materials 64 may be circulated through and out of the tubular string or casing of which the apparatus 10 is a part and into the wellbore 60. In several exemplary embodiments, the fluidic materials 64 may include drilling fluids, drilling mud, water, other types of fluidic materials, or any combination thereof.

Figure 16:
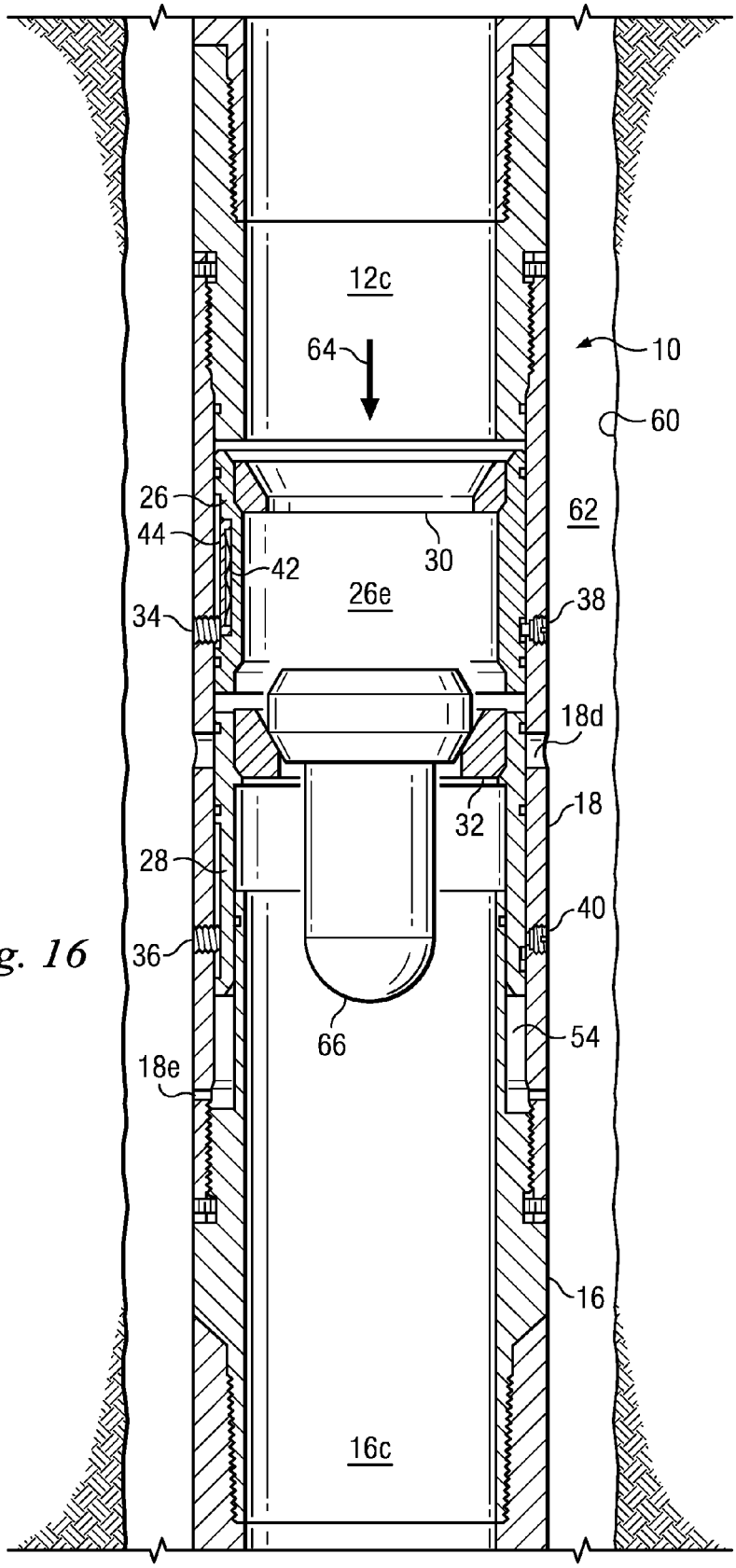
FIG. 16 is a partial sectional view of the stage tool apparatus of FIG. 1 extending within a wellbore and placed in an operational mode similar to that of FIG. 15, but also including a dart seated within the apparatus, according to an exemplary embodiment.

As illustrated in FIG. 16, a blocking element such as, for example, a dart 66, is injected into the apparatus 10 through at least the passage 12*c* and the internal passage 26*e* defined by the upper sleeve 26 until the dart 66 is seated in the lower seat 32. As a result, the flow of any fluidic materials, including the fluidic materials 64, through the lower sleeve 28 and therebelow is blocked.

Continued injection of the fluidic materials 64 into the apparatus 10, following the seating of the dart 66 in the lower seat 32, pressurizes the tubular string, of which the apparatus 10 is a part, above the dart 66. As a result, the dart 66, the lower seat 32 and the lower sleeve 28 are urged downward, relative to at least the outer sleeve 18 and the shear screws 40, so that a radially-extending surface 28*f* of the lower sleeve 28 that is defined by the annular channel 28*d* bears against the shear portions 40*d* of the respective shear screws 40. Continued injection of the fluidic materials 64 into the apparatus 10, following the surface 28*f* initially bearing against the shear portions 40*d*, causes the respective shear portions 40*d* of the shear screws 40 to shear, at which point the dart 66, the lower seat 32 and the lower sleeve 28 move downward, as viewed in FIG. 16, relative to the upper sleeve 26 and the outer sleeve 18 of the apparatus 10.

Figure 16A:
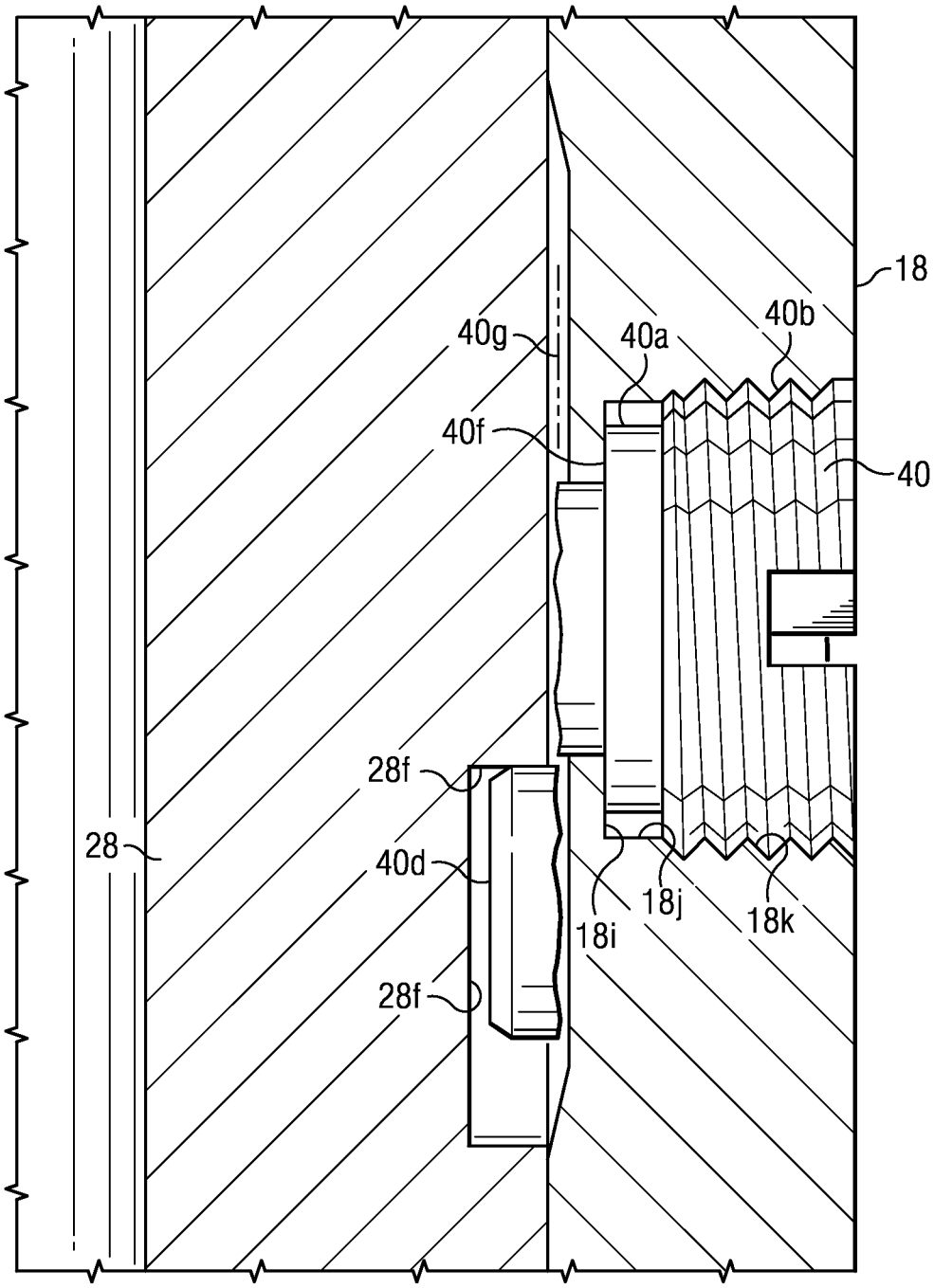
FIG. 16*a* is a partial sectional view of a shear screw when the stage tool apparatus of FIG. 1 is in the operational mode of FIG. 16, according to an exemplary embodiment.

As illustrated in FIG. 16*a*, each of the shear portions 40*d* shears along the respective shear plane 40*g*. Since the shear plane 40*g* is offset from, and generally parallel to, the flat 40*f* that is tightened against and engages the surface 18*i* of the outer sleeve 18, or since the shear plane 40*g* extends through the shear portion 40*d* rather than through, for example, the external threaded connection 40*b*, a cleaner shear along the shear plane 40*g* is achieved.

During the downward movement of the dart 66, the lower seat 32 and the lower sleeve 28, the channels 28*a* of the lower sleeve 28 move relative to the fasteners 36. As a result of the extension of the fasteners 36 into the respective channels 28*a*, the fasteners 36 guide the lower sleeve 28 as it moves downward, continuing to prevent or at least resist any relative rotation between the lower sleeve 28 and the outer sleeve 18. During the downward movement of the dart 66, the lower seat 32 and the lower sleeve 28, the lower end of the lower sleeve 28 is further received by the annular region 54.

Figure 17:
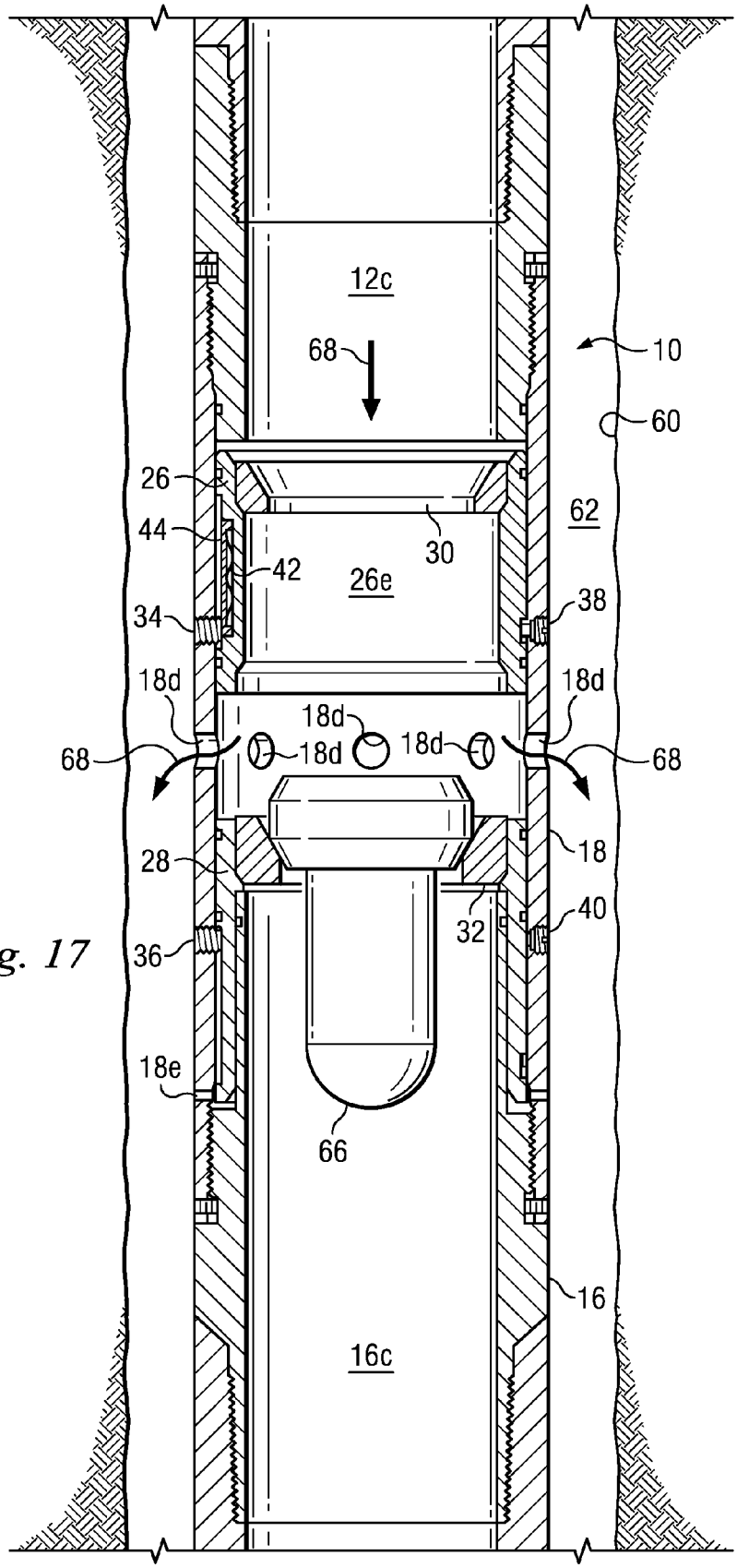
FIG. 17 is a partial sectional view of the stage tool apparatus of FIG. 1 extending within a wellbore and placed in an operational mode, according to an exemplary embodiment.

As illustrated in FIG. 17, the dart 66, the lower seat 32 and the lower sleeve 28 continue to move downward until the fasteners 36 engage the surfaces of the lower sleeve 28 defined by the upper ends of the respective channels 28*a*. As a result of these engagements, the lower sleeve 28 and thus the dart 66 and the lower seat 32 are prevented from moving any further downward. As a result of the downward movement of the dart 66, the lower seat 32 and the lower sleeve 28, the apparatus 10 is in an open configuration in which the ports 18*d* are not blocked by any of the upper sleeve 26 and the lower sleeve 28 and thus the annular region 62 is in fluid communication with at least the internal passage 12*c*, the internal passage 26*e* defined by the upper sleeve 26, and the internal passage 18*c* via the ports 18*d*.

In an exemplary embodiment, instead of placing the apparatus 10 in the open configuration mechanically via the engagement between the dart 66 and the lower seat 32 and the subsequent downward movement of the dart 66, the lower seat 32 and the lower sleeve 28, the apparatus 10 is placed in the open configuration hydraulically by pressurizing the tubular string of which the apparatus 10 is a part, and controlling the respective pressures within one or more of the wellbore 60, the annular region 62, and the tubular string including the apparatus 10, so that a differential pressure is created between the pressure applied against, inter alia, at least the lower seat 32 and the upper portion of the lower sleeve 28, and the pressure within the annular region 54. This differential pressure is increased by, for example, increasing the pressure applied against, inter alia, at least the lower seat 32 and the upper portion of the lower sleeve 28, so that the shear screws 40 are sheared and thus the lower seat 32 and the lower sleeve 28 move downward, as viewed in FIG. 17. The lower sleeve 28 moves downward in the annular region 54 with hydraulic lock being prevented by the ports 18*e*, via which the annular region 54 is in fluid communication with the annular region 62. In several exemplary embodiments, the ports 18*e* are bleed holes that prevent hydraulic lock.

With continuing reference to FIG. 17, before, during or after the downward movement of the lower seat 32 and the lower sleeve 28 (and the dart 66 if the apparatus 10 is placed in the open configuration mechanically), a fluidic material, such as a hardenable fluidic material 68, is injected into the apparatus 10 via the tubular string of which the apparatus 10 is a part, and into the internal passage 12*c*, the internal passage defined by the upper sleeve 26, and the internal passage 18*c*. The hardenable fluidic material 68 flows out of the apparatus 10 through the ports 18*d* of the outer sleeve 18 and into the annular region 62. As a result, an annular body of the hardenable fluidic material 68 is formed within the annular region 62. After the curing of the annular body of the hardenable fluidic material 68 within the annular region 62, the apparatus 10 and the tubular string of which the apparatus 10 is a part is better supported within the wellbore 60, and the portion of the annular region 62 or any formation below the annular body of the hardenable fluidic material 68 is fluidically isolated from the portion of the annular region 62 or any formation above the annular body of the hardenable fluidic material 68. In several exemplary embodiments, the improved support of the apparatus 10 or the tubular string of which the apparatus 10 is a part, or the fluidic isolation of the portion of the annular region 62 or any formation above the annular body of the hardenable fluidic material 68 from the portion of the annular region 62 or the any formation below the annular body, facilitate oil and gas exploration or production operations subsequent to the operation of the apparatus 10, as described above and below. In an exemplary embodiment, the hardenable fluidic material 68 is, or includes, cement. In an exemplary embodiment, the hardenable fluidic material 68 is, or includes, cement, and the completion of forming (and subsequently curing) the annular body of the material 68 is the completion of one stage in the stage cementing of the tubular string or casing of which the apparatus 10 is a part in the wellbore 60.

Figure 18:
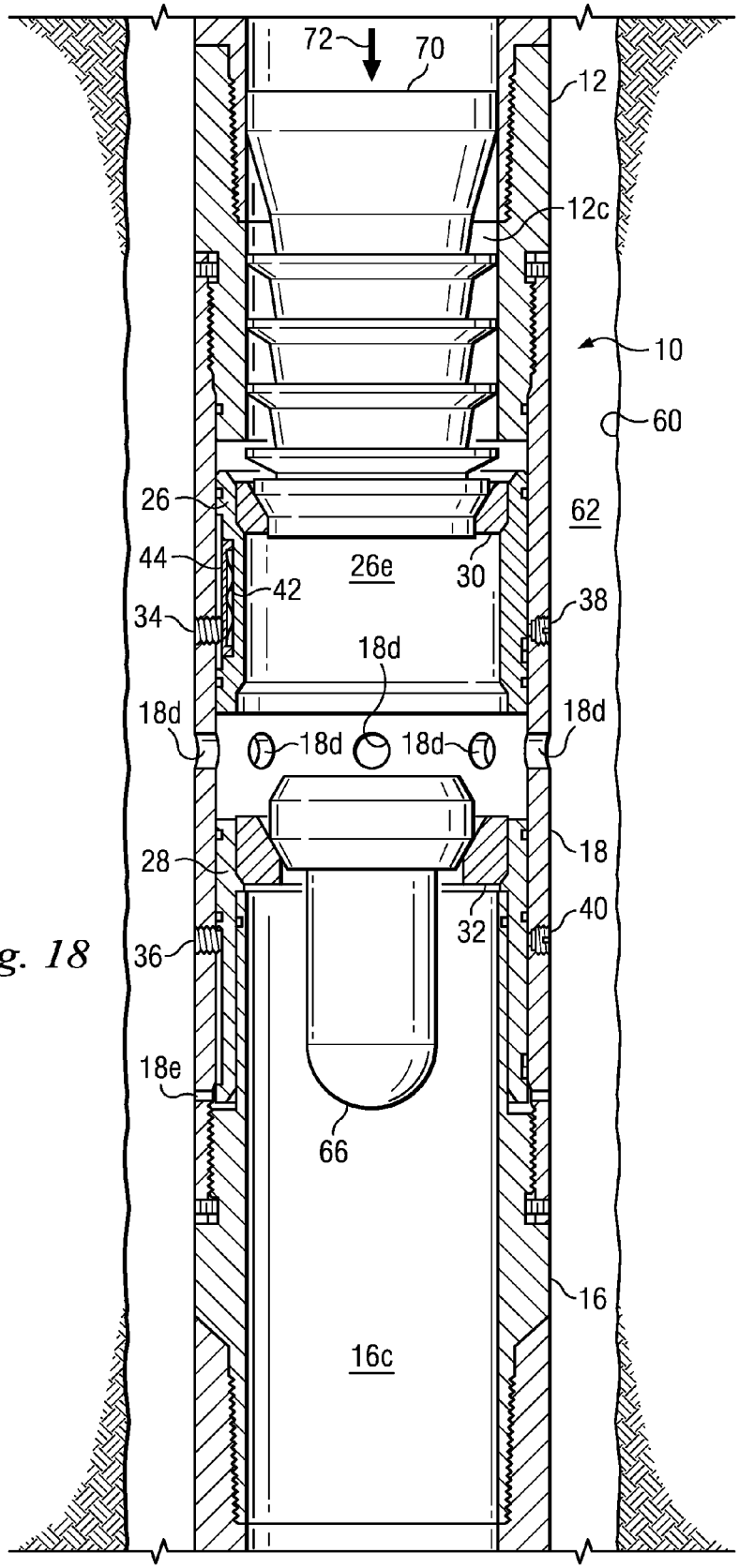
FIG. 18 is a partial sectional view of the stage tool apparatus of FIG. 1 extending within a wellbore and placed in an operational mode similar to that of FIG. 17, but also including a plug seated within the apparatus, according to an exemplary embodiment.

As illustrated in FIG. 18, before, during or after the curing of the annular body of the hardenable fluidic material 68, a blocking element such as, for example, a plug 70, is injected into the apparatus 10 through at least the passage 12*c*, until the plug 70 is seated in the upper seat 30. As a result, the flow of any fluidic materials through the upper sleeve 26 and the remainder of the apparatus 10 therebelow is blocked. Fluidic materials 72 are injected into the apparatus 10, following the seating of the plug 70 in the upper seat 30, thereby pressurizing the tubular string of which the apparatus 10 is a part. Continued injection of the fluidic materials 72 causes the respective shear portions 38*d* of the shear screws 38 to shear, at which point the plug 70, the upper seat 30 and the upper sleeve 26 move downward, as viewed in FIG. 18, relative to the outer sleeve 18 and the lower sleeve 28 of the apparatus 10. Each of the shear portions 38*d* shears along the respective shear plane 38*g*. Since the shear plane 38*g* is offset from, and generally parallel to, the flat 38*f* that is tightened against and engages the surface 18*f* of the outer sleeve 18, or since the shear plane 38*g* extends through the shear portion 38*d* rather than through, for example, the external threaded connection 38*b*, a cleaner shear along the shear plane 38*g* is achieved. During the downward movement of the plug 70, the upper seat 30, and the upper sleeve 26, the channels 26*a* of the upper sleeve 26, the springs 42, and the lock keys 44 move relative to the fasteners 34. As a result of the extension of the fasteners 34 into the respective channels 26*a*, the fasteners 34 guide the upper sleeve 28 as it moves downward, continuing to prevent or at least resist any relative rotation between the upper sleeve 26 and the outer sleeve 18.

Figure 18A:
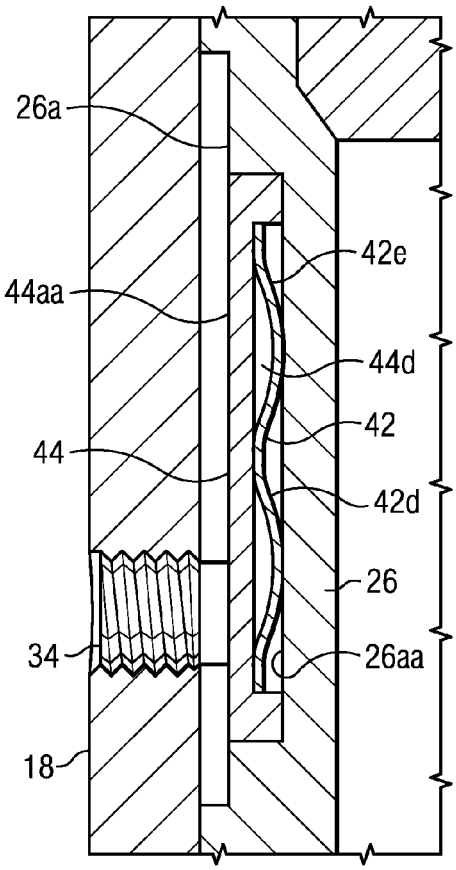
FIG. 18*a* is a view similar to that of FIG. 13, but depicting the portion shown in FIG. 13 when the stage tool apparatus of FIG. 1 is in the operational mode of FIG. 18, according to an exemplary embodiment.

As illustrated in FIG. 18*a*, during the downward movement of the upper sleeve 26, each of the lock keys 44 slides against the corresponding fastener 34, and conversely each of the fasteners 34 continues to engage the side 44*aa* of the corresponding lock key 44, thereby continuing to energize the corresponding spring 42. Since each of the fasteners 34 initially engages the side 44*aa* of the corresponding lock key 44 (as shown in FIG. 13), the lock key 44 moves relative to, and slides against, the fastener 34, and conversely the fastener 34 continues to engage the side 44*aa* of the lock key 44 during this relative movement, as shown in FIG. 18*a*.

Figure 19A:
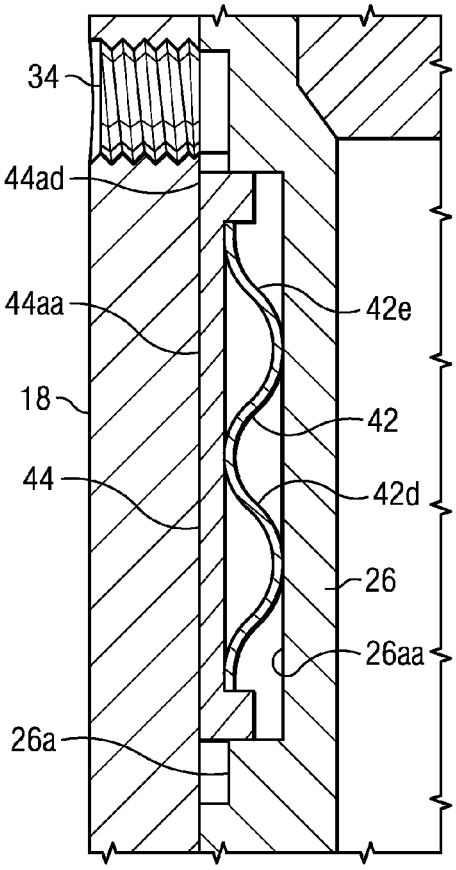
FIG. 19*a* is a view similar to that of FIG. 18*a*, but depicting the portion shown in FIG. 18*a* when the stage tool apparatus of FIG. 1 is in the operational mode of FIG. 19, according to an exemplary embodiment.
Figure 19:
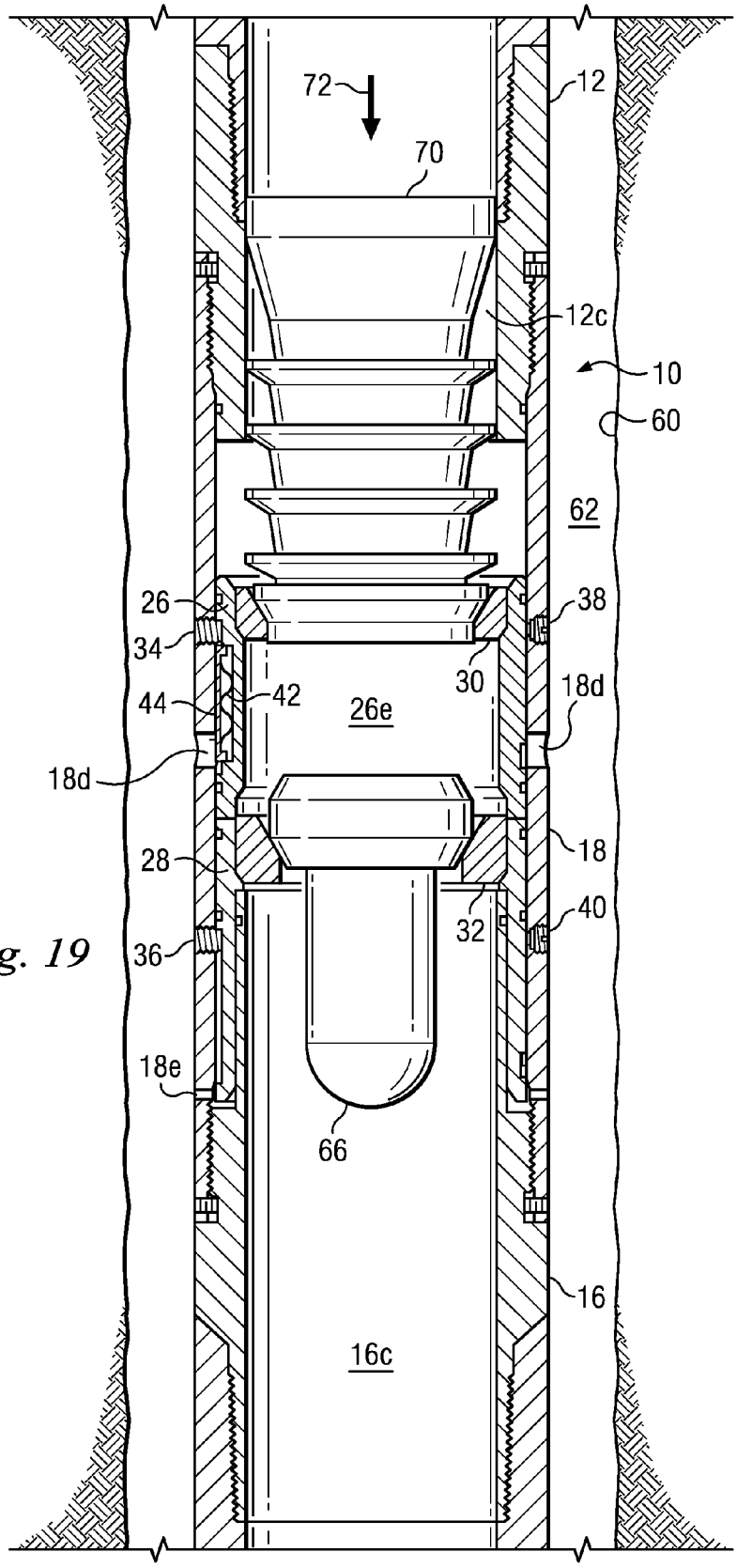
FIG. 19 is a partial sectional view of the stage tool apparatus of FIG. 1 extending within a wellbore and placed in an operational mode, according to an exemplary embodiment.

As illustrated in FIGS. 19 and 19*a*, the plug 70, the upper seat 30 and the upper sleeve 26 continue to move downward until the fasteners 34 engage the surfaces of the upper sleeve 26 defined by the upper ends of the respective channels 26*a* (shown in FIG. 19*a*). As a result of these engagements, the upper sleeve 26 and thus the plug 70 and the upper seat 30 are prevented from moving any further downward. As a result of this downward movement of the plug 70, the upper seat 30 and the upper sleeve 26, the apparatus 10 is in a closed configuration in which the ports 18*d* are blocked by the upper sleeve 26 and thus the annular region 62 is fluidically isolated from at least the internal passage 26*e* defined by the upper sleeve 26. As another result of this downward movement of the plug 70, the upper seat 30 and the upper sleeve 26, each of the fasteners 34 is no longer engaging the side 44*aa* of the bar member 44*a* of the respective lock key 44. As a result, the springs 42 sufficiently relax to push the respective lock keys 44 radially outward within the respective channels 26*a*.

As a result of the radially outward movement of the lock keys 44, the lock keys 44 are radially positioned so that each fastener 34 is axially disposed between a surface of the upper sleeve 26 defined by the upper end of the respective channel 26*a* and at least the end portion 44*ad* of the respective lock key 44, as shown in FIG. 19*a*. Moreover, each fastener 34 continues to be circumferentially disposed between the vertically-extending side walls of the upper sleeve 26 that are defined by the respective channel 26*a*. As a result, the upper sleeve 26 is jammed; the upper sleeve 26 cannot appreciably translate or rotate relative to the lower sleeve 28 or the outer sleeve 18.

The jammed upper sleeve 26 prevents any appreciable upward movement of the lower sleeve 28, as viewed in FIG. 19, and the respective engagements between the fasteners 36 and the surfaces of the lower sleeve 28 defined by the upper ends of the respective channels 28*a* prevent any downward movement of the lower sleeve 28, as viewed in FIG. 19. Moreover, each fastener 36 continues to be circumferentially disposed between the vertically-extending side walls of the lower sleeve 28 that are defined by the respective channel 28*a*. As a result, the lower sleeve 28 is jammed; the lower sleeve 28 is not permitted to appreciably translate or rotate relative to the upper sleeve 26 or the outer sleeve 18. Since neither the upper sleeve 26 nor the lower sleeve 28 is permitted to appreciably rotate or translate relative to each other or the outer sleeve 18, the apparatus 10 is thus locked in the closed configuration illustrated in FIG. 19. This locking of the upper sleeve 26 and the lower sleeve 28 facilitates any drill-out operation of the upper seat 30 and the lower seat 32.

As yet another result of the above-described downward movement of the upper sleeve 26, the upper sleeve 26 is engaged with the lower sleeve 28 so that lower end portions of the upper sleeve 26 defined by the arcuate notches 26*c* and 26*d* are again interposed between upper end portions of the lower sleeve 28 defined in part by the arcuate notch 28*c*; and axial gaps are defined between axially-facing end surfaces defined by the interposed lower end portions of the upper sleeve 26 and corresponding axially-facing end surfaces defined by the interposed upper end portions of the lower sleeve 28; in an exemplary embodiment, grease is disposed in the axial gaps to eliminate any metal-to-metal surface seal.

In an exemplary embodiment, after the apparatus 10 has been placed in the closed configuration illustrated in FIG. 19, a drill-out operation occurs during which at least the upper seat 30 and the lower seat 32 are drilled out. As noted above, the locking of the upper sleeve 26 and the lower sleeve 28 in the closed configuration illustrated in FIG. 19 assists in the drill-out operation by preventing the upper sleeve 26 and the lower sleeve 28 from appreciably translating or rotating within the outer sleeve 18 during the drill-out operation. In an exemplary embodiment, after the apparatus 10 has been placed in the closed configuration illustrated in FIG. 19, a drill-out operation occurs during which at least the plug 70, the upper seat 30, the dart 66 and the lower seat 32 are drilled out. As noted above, the locking of the upper sleeve 26 and the lower sleeve 28 in the closed configuration illustrated in FIG. 19 assists in the drill-out operation by preventing the upper sleeve 26 and the lower sleeve 28 from appreciably translating or rotating within the outer sleeve 18 during the drill-out operation.

In several exemplary embodiments, one or more additional stage tool apparatuses, each of which is substantially similar to the apparatus 10, are part of the tubular string or casing of which the apparatus 10 is a part.

An apparatus for forming an annular body of a fluidic material in a first annular region that is partially defined by a preexisting structure has been described that includes a first tubular member defining a first internal passage, wherein the outside surface of the first tubular member is adapted to partially define the first annular region; a second tubular member defining a second internal passage, the second tubular member extending within the first internal passage; a first axially-extending channel formed in the outside surface of the second tubular member; and a first component extending from the first tubular member and into the first axially-extending channel, the first component resisting relative rotation between the first and second tubular members; wherein the second tubular member is movable, relative to the first tubular member and the first component, from a first position to a second position. In an exemplary embodiment, as the second tubular member moves from the first position to the second position, the first component guides the second tubular member while continuing to resist relative rotation between the first and second tubular members. In an exemplary embodiment, the preexisting structure is a wellbore that traverses a subterranean formation; wherein the first tubular member includes a flow port that is not blocked by the second tubular member when the second tubular member is in one of the first and second positions; and wherein the second tubular member blocks the flow port when the second tubular member is in the other of the first and second positions. In an exemplary embodiment, the apparatus includes a lock key at least partially disposed within the first axially-extending channel, the lock key including a bar member; and a spring radially disposed between the bar member and the second tubular member; wherein, when the second tubular member is in the first position, the first component engages the bar member to thereby energize the spring; and wherein, when the second tubular member is in the second position: the spring is sufficiently relaxed to radially position the lock key so that the first component is axially disposed between the lock key and a first surface of the second tubular member defined by the first axially-extending channel, and the first component resists any further relative movement between the first and second tubular members while continuing to resist relative rotation between the first and second tubular members. In an exemplary embodiment, the bar member defines first and second sides spaced in a parallel relation; wherein the first component engages the first side of the bar member when the second tubular member is in the first position; and wherein the lock key further includes first and second protrusions extending from the second side of the bar member at opposing end portions thereof; and an axially-extending region defined by the bar member and the first and second protrusions; wherein the spring is at least partially disposed within the axially-extending region. In an exemplary embodiment, the spring includes first and second end portions positioned between the first and second protrusions of the lock key, each of the first and second end portions being engaged with the second side of the bar member; and an arcuate portion disposed between the first and second end portions, the arcuate portion being engaged with a second surface of the second tubular member defined by the axially-extending channel. In an exemplary embodiment, the axially-extending channel includes a recess in which at least a portion of the spring is disposed. In an exemplary embodiment, the apparatus includes an opening formed in the outside surface of the second tubular member; and a second component including a body coupled to the first tubular member; a shear portion extending from the body and into the opening; and a shoulder adjacent the proximal end of the shear portion, the shoulder defining a flat; wherein, when the second tubular member is in the first position, the shear portion resists relative movement between the first and second tubular members; and wherein, as the second tubular member moves from the first position to the second position, the shear portion of the second component shears along a shear plane that is offset from, and generally parallel to, the flat defined by the shoulder. In an exemplary embodiment, the apparatus includes a third tubular member defining a third internal passage, the third tubular member extending within the first internal passage; a second axially-extending channel formed in the outside surface of the third tubular member; a second component extending from the first tubular member and into the second axially-extending channel, the second component resisting relative rotation between the first and third tubular members; wherein the third tubular member is movable, relative to the first tubular member and the second component, from a third position to a fourth position; and wherein, as the third tubular member moves from the third position to the fourth position, the second component guides the third tubular member while continuing to resist relative rotation between the first and third tubular members. In an exemplary embodiment, the preexisting structure is a wellbore that traverses a subterranean formation; wherein the first tubular member includes a first flow port that is blocked by the third tubular member when the second tubular member is in the first position and the third tubular member is in the third position; wherein the first flow port is not blocked by the third tubular member when the second tubular member is in the first position and the third tubular member is in the fourth position; and wherein the first flow port is blocked by the second tubular member when the second tubular member is in the second position and the third tubular member is in the fourth position. In an exemplary embodiment, the apparatus includes a fourth tubular member coupled to the first tubular member, the fourth tubular member including an end portion that extends within the first internal passage; and a second annular region defined between the first and fourth tubular members and within which the third tubular member moves as the third tubular member moves from the third position to the fourth position; wherein the first tubular member includes a second flow port through which the second annular region is in fluid communication with the first annular region, the second flow port preventing hydraulic lock as the third tubular member moves from the third position to the fourth position.

An apparatus for forming an annular body of a fluidic material in a first annular region that is partially defined by a preexisting structure has been described that includes a first tubular member defining a first internal passage, wherein the outside surface of the first tubular member is adapted to partially define the first annular region; a second tubular member defining a second internal passage, the second tubular member extending within the first internal passage; an opening formed in the outside surface of the second tubular member; and a first component including a body coupled to the first tubular member; a shear portion extending from the body and into the opening; and a shoulder adjacent the proximal end of the shear portion, the shoulder defining a flat; wherein the second tubular member is movable, relative to the first tubular member, from a first position to a second position; wherein, when the second tubular member is in the first position, the shear portion resists relative movement between the first and second tubular members; and wherein, as the second tubular member moves from the first position to the second position, the shear portion of the second component shears along a shear plane that is offset from, and generally parallel to, the flat defined by the shoulder. In an exemplary embodiment, the preexisting structure is a wellbore that traverses a subterranean formation; wherein the first tubular member includes a flow port that is not blocked by the second tubular member when the second tubular member is in one of the first and second positions; and wherein the second tubular member blocks the flow port when the second tubular member is in the other of the first and second positions. In an exemplary embodiment, the apparatus includes a first axially-extending channel formed in the outside surface of the second tubular member; and a second component extending from the first tubular member and into the first axially-extending channel, the first component resisting relative rotation between the first and second tubular members; wherein, as the second tubular member moves from the first position to the second position, the first component guides the second tubular member while continuing to resist relative rotation between the first and second tubular members. In an exemplary embodiment, the apparatus includes a lock key at least partially disposed within the first axially-extending channel, the lock key including a bar member; and a spring radially disposed between the bar member and the second tubular member; wherein, when the second tubular member is in the first position, the second component engages the bar member to thereby energize the spring; and wherein, when the second tubular member is in the second position: the spring is sufficiently relaxed to radially position the lock key so that the second component is axially disposed between the lock key and a first surface of the second tubular member defined by the first axially-extending channel, and the second component resists any further relative movement between the first and second tubular members while continuing to resist relative rotation between the first and second tubular members. In an exemplary embodiment, the bar member defines first and second sides spaced in a parallel relation; wherein the second component engages the first side of the bar member when the second tubular member is in the first position; and wherein the lock key further includes first and second protrusions extending from the second side of the bar member at opposing end portions thereof; and an axially-extending region defined by the bar member and the first and second protrusions; wherein the spring is at least partially disposed within the axially-extending region. In an exemplary embodiment, the spring includes first and second end portions positioned between the first and second protrusions of the lock key, each of the first and second end portions being engaged with the second side of the bar member; and an arcuate portion disposed between the first and second end portions, the arcuate portion being engaged with a second surface of the second tubular member defined by the axially-extending channel. In an exemplary embodiment, the axially-extending channel includes a recess in which at least a portion of the spring is disposed. In an exemplary embodiment, the apparatus includes a third tubular member defining a third internal passage, the third tubular member extending within the first internal passage; a second axially-extending channel formed in the outside surface of the third tubular member; a second component extending from the first tubular member and into the second axially-extending channel, the second component resisting relative rotation between the first and third tubular members; wherein the third tubular member is movable, relative to the first tubular member and the second component, from a third position to a fourth position; and wherein, as the third tubular member moves from the third position to the fourth position, the second component guides the third tubular member while continuing to resist relative rotation between the first and third tubular members. In an exemplary embodiment, the preexisting structure is a wellbore that traverses a subterranean formation; wherein the first tubular member includes a first flow port that is blocked by the third tubular member when the second tubular member is in the first position and the third tubular member is in the third position; wherein the first flow port is not blocked by the third tubular member when the second tubular member is in the first position and the third tubular member is in the fourth position; and wherein the first flow port is blocked by the second tubular member when the second tubular member is in the second position and the third tubular member is in the fourth position. In an exemplary embodiment, the apparatus includes a fourth tubular member coupled to the first tubular member, the fourth tubular member including an end portion that extends within the first internal passage; and a second annular region defined between the first and fourth tubular members and within which the third tubular member moves as the third tubular member moves from the third position to the fourth position; wherein the first tubular member includes a second flow port through which the second annular region is in fluid communication with the first annular region, the second flow port preventing hydraulic lock as the third tubular member moves from the third position to the fourth position.

An apparatus for forming an annular body of a fluidic material in a first annular region that is partially defined by a wellbore that traverses a subterranean formation has been described that includes a first tubular member defining a first internal passage and including a flow port, wherein the outside surface of the first tubular member is adapted to partially define the first annular region; a second tubular member defining a second internal passage, the second tubular member extending within the first internal passage; a first axially-extending channel formed in the outside surface of the second tubular member; a first component extending from the first tubular member and into the first axially-extending channel, the first component resisting relative rotation between the first and second tubular members; a lock key at least partially disposed within the first axially-extending channel, the lock key including a bar member defining first and second sides spaced in a parallel relation; first and second protrusions extending from the second side of the bar member at opposing end portions thereof; and an axially-extending region defined by the bar member and the first and second protrusions; a spring radially disposed between the bar member and the second tubular member and at least partially disposed within the axially-extending region of the lock key, the spring including first and second end portions positioned between the first and second protrusions of the lock key, each of the first and second end portions being engaged with the second side of the bar member; and an arcuate portion disposed between the first and second end portions, the arcuate portion being engaged with a first surface of the second tubular member defined by the axially-extending channel; an opening formed in the outside surface of the second tubular member; a second component including a body coupled to the first tubular member; a shear portion extending from the body and into the opening; and a shoulder adjacent the proximal end of the shear portion, the shoulder defining a flat; a third tubular member defining a third internal passage, the third tubular member extending within the first internal passage; a second axially-extending channel formed in the outside surface of the third tubular member; and a third component extending from the first tubular member and into the second axially-extending channel, the third component resisting relative rotation between the first and third tubular members. In an exemplary embodiment, the second tubular member is movable, relative to the first tubular member and the first component, from a first position to a second position; wherein, when the second tubular member is in the first position: the first component engages the first side of the bar member to thereby energize the spring, and the shear portion resists relative movement between the first and second tubular members; wherein, as the second tubular member moves from the first position to the second position: the first component guides the second tubular member while continuing to resist relative rotation between the first and second tubular members, and the shear portion of the second component shears along a shear plane that is offset from, and generally parallel to, the flat defined by the shoulder; wherein, when the second tubular member is in the second position: the spring is sufficiently relaxed to radially position the lock key so that the first component is axially disposed between the lock key and a second surface of the second tubular member defined by the first axially-extending channel, and the first component resists any further relative movement between the first and second tubular members while continuing to resist relative rotation between the first and second tubular members; wherein the third tubular member is movable, relative to the first tubular member and the third component, from a third position to a fourth position; wherein, as the third tubular member moves from the third position to the fourth position, the third component guides the third tubular member while continuing to resist relative rotation between the first and third tubular members; wherein the first flow port is blocked by the third tubular member when the second tubular member is in the first position and the third tubular member is in the third position; wherein the first flow port is not blocked by the third tubular member when the second tubular member is in the first position and the third tubular member is in the fourth position; and wherein the first flow port is blocked by the second tubular member when the second tubular member is in the second position and the third tubular member is in the fourth position.

A method of forming an annular body of a fluidic material in a first annular region that is partially defined by a wellbore that traverses a subterranean formation has been described that includes providing an assembly including a first tubular member that defines a first internal passage; extending a second tubular member within the first internal passage, the second tubular member forming part of the assembly; positioning the assembly in the wellbore so that the outside surface of the first tubular member partially defines the first annular region; resisting relative rotation between the first and second tubular members; moving the second tubular member, relative to the first tubular member, from a first position to a second position; and during moving the second tubular member to the second position, guiding the second tubular member while continuing to resist relative rotation between the first and second tubular members. In an exemplary embodiment, the method includes after moving the second tubular member to the second position, locking the tubular member by resisting any further relative movement between the first and second tubular members while continuing to resist relative rotation between the first and second tubular members. In an exemplary embodiment, the method includes resisting relative movement between the first and second tubular members when the second tubular member is in the first position; and removing the resistance to the relative movement between the first and second tubular members before the second tubular member has reached the second position. In an exemplary embodiment, the method includes extending a third tubular member within the first internal passage before positioning the assembly in the wellbore, the third tubular member forming part of the assembly; resisting relative rotation between the first and third tubular members; moving the third tubular member from a third position to a fourth position; and during moving the third tubular member from the third position to the fourth position, guiding the third tubular member while continuing to resist relative rotation between the first and third tubular members. In an exemplary embodiment, the method includes preventing the fluidic material from flowing from the first internal passage and into the first annular region when the second tubular member is in the first position and the third tubular member is in the third position; permitting the fluidic material to flow from the first internal passage and into the first annular region when the second tubular member is in the first position and the third tubular member is in the fourth position; and preventing the fluidic material from flowing from the first internal passage and into the first annular region when the second tubular member is in the second position and the third tubular member is in the fourth position. In an exemplary embodiment, the method includes before positioning the assembly in the wellbore, extending a fourth tubular member within the first internal passage so that a second annular region is defined between the first and fourth tubular members, the fourth tubular member forming part of the assembly, wherein the third tubular member moves within the second annular region as the third tubular member moves from the third position to the fourth position; and preventing hydraulic lock as the third tubular member moves from the third position to the fourth position.

A system for forming an annular body of a fluidic material in a first annular region that is partially defined by a wellbore that traverses a subterranean formation has been described that includes an assembly including a first tubular member that defines a first internal passage, and a second tubular member extending within the first internal passage, wherein the outside surface of the first tubular member partially defines the first annular region when the assembly is positioned in the wellbore; means for resisting relative rotation between the first and second tubular members; means for moving the second tubular member, relative to the first tubular member, from a first position to a second position; and means for during moving the second tubular member to the second position, guiding the second tubular member while continuing to resist relative rotation between the first and second tubular members. In an exemplary embodiment, the system includes means for after moving the second tubular member to the second position, locking the tubular member by resisting any further relative movement between the first and second tubular members while continuing to resist relative rotation between the first and second tubular members. In an exemplary embodiment, the system includes means for resisting relative movement between the first and second tubular members when the second tubular member is in the first position; and means for removing the resistance to the relative movement between the first and second tubular members before the second tubular member has reached the second position. In an exemplary embodiment, the assembly further includes a third tubular member extending within the first internal passage; and wherein the system further includes means for resisting relative rotation between the first and third tubular members; means for moving the third tubular member from a third position to a fourth position; and means for during moving the third tubular member from the third position to the fourth position, guiding the third tubular member while continuing to resist relative rotation between the first and third tubular members. In an exemplary embodiment, the system includes means for preventing the fluidic material from flowing from the first internal passage and into the first annular region when the second tubular member is in the first position and the third tubular member is in the third position; means for permitting the fluidic material to flow from the first internal passage and into the first annular region when the second tubular member is in the first position and the third tubular member is in the fourth position; and means for preventing the fluidic material from flowing from the first internal passage and into the first annular region when the second tubular member is in the second position and the third tubular member is in the fourth position. In an exemplary embodiment, the assembly further includes a fourth tubular member within the first internal passage so that a second annular region is defined between the first and fourth tubular members, wherein the third tubular member moves within the second annular region as the third tubular member moves from the third position to the fourth position; and wherein the system further includes means for preventing hydraulic lock as the third tubular member moves from the third position to the fourth position.

It is understood that variations may be made in the foregoing without departing from the scope of the disclosure.

In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, or combined, at least in part, with one or more of the other elements and teachings of the various illustrative embodiments.

Any spatial references such as, for example, "upper," "lower," "above," "below," "between," "bottom," "vertical," "horizontal," "angular," "upwards," "downwards," "side-to-side," "left-to-right," "left," "right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, or one or more of the procedures may also be performed in different orders, simultaneously or sequentially. In several exemplary embodiments, the steps, processes or procedures may be merged into one or more steps, processes or procedures. In several exemplary embodiments, one or more of the operational steps in each embodiment may be omitted. Moreover, in some instances, some features of the present disclosure may be employed without a corresponding use of the other features. Moreover, one or more of the above-described embodiments or variations may be combined in whole or in part with any one or more of the other above-described embodiments or variations.

Although several exemplary embodiments have been described in detail above, the embodiments described are exemplary only and are not limiting, and those skilled in the art will readily appreciate that many other modifications, changes or substitutions are possible in the exemplary embodiments without materially departing from the novel teachings and advantages of the present disclosure. Accordingly, all such modifications, changes or substitutions are intended to be included within the scope of this disclosure as defined in the following claims. In the claims, means-plus-function clauses are intended to cover the structures described herein as performing the recited function and not only structural equivalents, but also equivalent structures.

What is claimed is:

1. Apparatus for forming an annular body of a fluidic material in a first annular region that is partially defined by a preexisting structure, the apparatus comprising:

a first tubular member defining a first internal passage, wherein the outside surface of the first tubular member is adapted to partially define the first annular region;

a second tubular member defining a second internal passage, the second tubular member extending within the first internal passage;

a first axially-extending channel formed in the outside surface of the second tubular member;

a first component extending from the first tubular member and into the first axially-extending channel, the first component resisting relative rotation between the first and second tubular members;

a lock key at least partially disposed within the first axially-extending channel, the lock key comprising a bar member; and a spring radially disposed between the bar member and the second tubular member;

wherein the second tubular member is movable, relative to the first tubular member and the first component, from a first position to a second position;

wherein, when the second tubular member is in the first position, the first component engages the bar member to thereby energize the spring; and wherein, when the second tubular member is in the second position:

the spring is sufficiently relaxed to radially position the lock key so that the first component is axially disposed between the lock key and a first surface of the second tubular member defined by the first axially-extending channel, and the axial position of the first component resists any further relative movement between the first and second tubular members while continuing to resist relative rotation between the first and second tubular members.

2. The apparatus of claim 1, wherein, as the second tubular member moves from the first position to the second position, the first component guides the second tubular member while continuing to resist relative rotation between the first and second tubular members.

3. The apparatus of claim 1, wherein the preexisting structure is a wellbore that traverses a subterranean formation;

wherein the first tubular member comprises a flow port that is not blocked by the second tubular member when the second tubular member is in one of the first and second positions; and wherein the second tubular member blocks the flow port when the second tubular member is in the other of the first and second positions.

4. The apparatus of claim 1, wherein the bar member defines first and second sides spaced in a parallel relation;

wherein the first component engages the first side of the bar member when the second tubular member is in the first position; and wherein the lock key further comprises:

first and second protrusions extending from the second side of the bar member at opposing end portions thereof; and an axially-extending region defined by the bar member and the first and second protrusions;

wherein the spring is at least partially disposed within the axially-extending region.

5. The apparatus of claim 4, wherein the spring comprises:

first and second end portions positioned between the first and second protrusions of the lock key, each of the first and second end portions being engaged with the second side of the bar member; and an arcuate portion disposed between the first and second end portions, the arcuate portion being engaged with a second surface of the second tubular member defined by the axially-extending channel.

6. The apparatus of claim 4, wherein the axially-extending channel includes a recess in which at least a portion of the spring is disposed.

7. The apparatus of claim 1, further comprising:

an opening formed in the outside surface of the second tubular member; and a second component comprising:

a body coupled to the first tubular member;

a shear portion extending from the body and into the opening; and a shoulder adjacent the proximal end of the shear portion, the shoulder defining a flat;

wherein, when the second tubular member is in the first position, the shear portion resists relative movement between the first and second tubular members; and wherein, as the second tubular member moves from the first position to the second position, the shear portion of the second component shears along a shear plane that is offset from, and generally parallel to, the flat defined by the shoulder.

8. The apparatus of claim 1, further comprising:

a third tubular member defining a third internal passage, the third tubular member extending within the first internal passage;

a second axially-extending channel formed in the outside surface of the third tubular member;

a second component extending from the first tubular member and into the second axially-extending channel, the second component resisting relative rotation between the first and third tubular members;

wherein the third tubular member is movable, relative to the first tubular member and the second component, from a third position to a fourth position; and wherein, as the third tubular member moves from the third position to the fourth position, the second component guides the third tubular member while continuing to resist relative rotation between the first and third tubular members.

9. The apparatus of claim 8, wherein the preexisting structure is a wellbore that traverses a subterranean formation;

wherein the first tubular member comprises a first flow port that is blocked by the third tubular member when the second tubular member is in the first position and the third tubular member is in the third position;

wherein the first flow port is not blocked by the third tubular member when the second tubular member is in the first position and the third tubular member is in the fourth position; and wherein the first flow port is blocked by the second tubular member when the second tubular member is in the second position and the third tubular member is in the fourth position.

10. Apparatus for forming an annular body of a fluidic material in a first annular region that is partially defined by a preexisting structure, the apparatus comprising:

a first tubular member defining a first internal passage, wherein the outside surface of the first tubular member is adapted to partially define the first annular region;

a second tubular member defining a second internal passage, the second tubular member extending within the first internal passage;

a first axially-extending channel formed in the outside surface of the second tubular member; and a first component extending from the first tubular member and into the first axially-extending channel, the first component resisting relative rotation between the first and second tubular members;

wherein the second tubular member is movable, relative to the first tubular member and the first component, from a first position to a second position;

wherein the apparatus further comprises:

a third tubular member defining a third internal passage, the third tubular member extending within the first internal passage;

a second axially-extending channel formed in the outside surface of the third tubular member; and a second component extending from the first tubular member and into the second axially-extending channel, the second component resisting relative rotation between the first and third tubular members;

wherein the third tubular member is movable, relative to the first tubular member and the second component, from a third position to a fourth position;

wherein, as the third tubular member moves from the third position to the fourth position, the second component guides the third tubular member while continuing to resist relative rotation between the first and third tubular members; and wherein the apparatus further comprises:

a fourth tubular member coupled to the first tubular member, the fourth tubular member comprising an end portion that extends within the first internal passage; and a second annular region defined between the first and fourth tubular members and within which the third tubular member moves as the third tubular member moves from the third position to the fourth position;

wherein the first tubular member comprises a second flow port through which the second annular region is in fluid communication with the first annular region, the second flow port preventing hydraulic lock as the third tubular member moves from the third position to the fourth position.

11. Apparatus for forming an annular body of a fluidic material in a first annular region that is partially defined by a preexisting structure, the apparatus comprising:

a first tubular member defining a first internal passage, wherein the outside surface of the first tubular member is adapted to partially define the first annular region;

a second tubular member defining a second internal passage, the second tubular member extending within the first internal passage;

an opening formed in the outside surface of the second tubular member; and a first component comprising:

a body coupled to the first tubular member;

a shear portion extending from the body and into the opening; and a shoulder adjacent the proximal end of the shear portion, the shoulder defining a flat;

wherein a longitudinal axis of the shear portion is perpendicular to the flat;

wherein the second tubular member is movable, relative to the first tubular member, from a first position to a second position;

wherein, when the second tubular member is in the first position, the shear portion resists relative movement between the first and second tubular members; and wherein, as the second tubular member moves from the first position to the second position, the shear portion of the first component shears along a shear plane that is offset from, and generally parallel to, the flat defined by the shoulder.

12. The apparatus of claim 11, wherein the preexisting structure is a wellbore that traverses a subterranean formation;

wherein the first tubular member comprises a flow port that is not blocked by the second tubular member when the second tubular member is in one of the first and second positions; and wherein the second tubular member blocks the flow port when the second tubular member is in the other of the first and second positions.

13. The apparatus of claim 11, further comprising:

a first axially-extending channel formed in the outside surface of the second tubular member; and a second component extending from the first tubular member and into the first axially-extending channel, the first component resisting relative rotation between the first and second tubular members;

wherein, as the second tubular member moves from the first position to the second position, the first component guides the second tubular member while continuing to resist relative rotation between the first and second tubular members.

14. The apparatus of claim 13, further comprising:

a lock key at least partially disposed within the first axially-extending channel, the lock key comprising a bar member; and a spring radially disposed between the bar member and the second tubular member;

wherein, when the second tubular member is in the first position, the second component engages the bar member to thereby energize the spring; and wherein, when the second tubular member is in the second position:

the spring is sufficiently relaxed to radially position the lock key so that the second component is axially disposed between the lock key and a first surface of the second tubular member defined by the first axially-extending channel, and the second component resists any further relative movement between the first and second tubular members while continuing to resist relative rotation between the first and second tubular members.

15. The apparatus of claim 14, wherein the bar member defines first and second sides spaced in a parallel relation;

wherein the second component engages the first side of the bar member when the second tubular member is in the first position; and wherein the lock key further comprises:

first and second protrusions extending from the second side of the bar member at opposing end portions thereof; and an axially-extending region defined by the bar member and the first and second protrusions;

wherein the spring is at least partially disposed within the axially-extending region.

16. The apparatus of claim 15, wherein the spring comprises:

first and second end portions positioned between the first and second protrusions of the lock key, each of the first and second end portions being engaged with the second side of the bar member; and an arcuate portion disposed between the first and second end portions, the arcuate portion being engaged with a second surface of the second tubular member defined by the axially-extending channel.

17. The apparatus of claim 15, wherein the axially-extending channel includes a recess in which at least a portion of the spring is disposed.

18. The apparatus of claim 11, further comprising:

a third tubular member defining a third internal passage, the third tubular member extending within the first internal passage;

a second axially-extending channel formed in the outside surface of the third tubular member;

a second component extending from the first tubular member and into the second axially-extending channel, the second component resisting relative rotation between the first and third tubular members;

wherein the third tubular member is movable, relative to the first tubular member and the second component, from a third position to a fourth position; and wherein, as the third tubular member moves from the third position to the fourth position, the second component guides the third tubular member while continuing to resist relative rotation between the first and third tubular members.

19. The apparatus of claim 18, wherein the preexisting structure is a wellbore that traverses a subterranean formation;

wherein the first tubular member comprises a first flow port that is blocked by the third tubular member when the second tubular member is in the first position and the third tubular member is in the third position;

wherein the first flow port is not blocked by the third tubular member when the second tubular member is in the first position and the third tubular member is in the fourth position; and wherein the first flow port is blocked by the second tubular member when the second tubular member is in the second position and the third tubular member is in the fourth position.

20. Apparatus for forming an annular body of a fluidic material in a first annular region that is partially defined by a preexisting structure, the apparatus comprising:

a first tubular member defining a first internal passage, wherein the outside surface of the first tubular member is adapted to partially define the first annular region;

a second tubular member defining a second internal passage, the second tubular member extending within the first internal passage;

an opening formed in the outside surface of the second tubular member; and a first component comprising:

a body coupled to the first tubular member;

a shear portion extending from the body and into the opening; and a shoulder adjacent the proximal end of the shear portion, the shoulder defining a flat;

wherein the second tubular member is movable, relative to the first tubular member, from a first position to a second position;

wherein, when the second tubular member is in the first position, the shear portion resists relative movement between the first and second tubular members;

wherein, as the second tubular member moves from the first position to the second position, the shear portion of the first component shears along a shear plane that is offset from, and generally parallel to, the flat defined by the shoulder;

wherein the apparatus further comprises:

a third tubular member defining a third internal passage, the third tubular member extending within the first internal passage;

a second axially-extending channel formed in the outside surface of the third tubular member; and a second component extending from the first tubular member and into the second axially-extending channel, the second component resisting relative rotation between the first and third tubular members;

wherein the third tubular member is movable, relative to the first tubular member and the second component, from a third position to a fourth position;

wherein, as the third tubular member moves from the third position to the fourth position, the second component guides the third tubular member while continuing to resist relative rotation between the first and third tubular members; and wherein the apparatus further comprises:

a fourth tubular member coupled to the first tubular member, the fourth tubular member comprising an end portion that extends within the first internal passage; and a second annular region defined between the first and fourth tubular members and within which the third tubular member moves as the third tubular member moves from the third position to the fourth position;

wherein the first tubular member comprises a second flow port through which the second annular region is in fluid communication with the first annular region, the second flow port preventing hydraulic lock as the third tubular member moves from the third position to the fourth position.

21. Apparatus for forming an annular body of a fluidic material in a first annular region that is partially defined by a wellbore that traverses a subterranean formation, the apparatus comprising:

a first tubular member defining a first internal passage and comprising a flow port, wherein the outside surface of the first tubular member is adapted to partially define the first annular region;

a second tubular member defining a second internal passage, the second tubular member extending within the first internal passage;

a first axially-extending channel formed in the outside surface of the second tubular member;

a first component extending from the first tubular member and into the first axially-extending channel, the first component resisting relative rotation between the first and second tubular members;

a lock key at least partially disposed within the first axially-extending channel, the lock key comprising:

a bar member defining first and second sides spaced in a parallel relation;

first and second protrusions extending from the second side of the bar member at opposing end portions thereof; and an axially-extending region defined by the bar member and the first and second protrusions;

a spring radially disposed between the bar member and the second tubular member and at least partially disposed within the axially-extending region of the lock key, the spring comprising:

first and second end portions positioned between the first and second protrusions of the lock key, each of the first and second end portions being engaged with the second side of the bar member; and an arcuate portion disposed between the first and second end portions, the arcuate portion being engaged with a first surface of the second tubular member defined by the axially-extending channel;

an opening formed in the outside surface of the second tubular member;

a second component comprising:

a body coupled to the first tubular member;

a shear portion extending from the body and into the opening; and a shoulder adjacent the proximal end of the shear portion, the shoulder defining a flat;

wherein a longitudinal axis of the shear portion is perpendicular to the flat;

a third tubular member defining a third internal passage, the third tubular member extending within the first internal passage;

a second axially-extending channel formed in the outside surface of the third tubular member; and a third component extending from the first tubular member and into the second axially-extending channel, the third component resisting relative rotation between the first and third tubular members.

22. The apparatus of claim 21, wherein the second tubular member is movable, relative to the first tubular member and the first component, from a first position to a second position;

wherein, when the second tubular member is in the first position:

the first component engages the first side of the bar member to thereby energize the spring, and the shear portion resists relative movement between the first and second tubular members;

wherein, as the second tubular member moves from the first position to the second position:

the first component guides the second tubular member while continuing to resist relative rotation between the first and second tubular members, and the shear portion of the second component shears along a shear plane that is offset from, and generally parallel to, the flat defined by the shoulder;

wherein, when the second tubular member is in the second position:

the spring is sufficiently relaxed to radially position the lock key so that the first component is axially disposed between the lock key and a second surface of the second tubular member defined by the first axially-extending channel, and the first component resists any further relative movement between the first and second tubular members while continuing to resist relative rotation between the first and second tubular members;

wherein the third tubular member is movable, relative to the first tubular member and the third component, from a third position to a fourth position;

wherein, as the third tubular member moves from the third position to the fourth position, the third component guides the third tubular member while continuing to resist relative rotation between the first and third tubular members;

wherein the first flow port is blocked by the third tubular member when the second tubular member is in the first position and the third tubular member is in the third position;

wherein the first flow port is not blocked by the third tubular member when the second tubular member is in the first position and the third tubular member is in the fourth position; and wherein the first flow port is blocked by the second tubular member when the second tubular member is in the second position and the third tubular member is in the fourth position.

23. A method of forming an annular body of a fluidic material in a first annular region that is partially defined by a wellbore that traverses a subterranean formation, the method comprising:

providing an assembly comprising a first tubular member that defines a first internal passage;

extending a second tubular member within the first internal passage, the second tubular member forming part of the assembly;

positioning the assembly in the wellbore so that the outside surface of the first tubular member partially defines the first annular region;

resisting relative rotation between the first and second tubular members;

moving the second tubular member, relative to the first tubular member, from a first position to a second position;

during moving the second tubular member to the second position, guiding the second tubular member while continuing to resist relative rotation between the first and second tubular members;

after moving the second tubular member to the second position, locking the second tubular member by resisting any further relative movement between the first and second tubular members while continuing to resist relative rotation between the first and second tubular members;

extending a third tubular member within the first internal passage before positioning the assembly in the wellbore, the third tubular member forming part of the assembly;

resisting relative rotation between the first and third tubular members;

moving the third tubular member from a third position to a fourth position;

during moving the third tubular member from the third position to the fourth position, guiding the third tubular member while continuing to resist relative rotation between the first and third tubular members;

preventing the fluidic material from flowing from the first internal passage and into the first annular region when the second tubular member is in the first position and the third tubular member is in the third position;

permitting the fluidic material to flow from the first internal passage and into the first annular region when the second tubular member is in the first position and the third tubular member is in the fourth position;

preventing the fluidic material from flowing from the first internal passage and into the first annular region when the second tubular member is in the second position and the third tubular member is in the fourth position;

before positioning the assembly in the wellbore, extending a fourth tubular member within the first internal passage so that a second annular region is defined between the first and fourth tubular members, the fourth tubular member forming part of the assembly, wherein the third tubular member moves within the second annular region as the third tubular member moves from the third position to the fourth position; and preventing hydraulic lock as the third tubular member moves from the third position to the fourth position.

24. Apparatus for forming an annular body of a fluidic material in a first annular region that is partially defined by a preexisting structure, the apparatus comprising:

a first tubular member defining a first internal passage, wherein the first tubular member comprises a first flow port, and wherein the outside surface of the first tubular member is adapted to partially define the first annular region;

a second tubular member defining a second internal passage, the second tubular member extending within the first internal passage, wherein the second tubular member is movable, relative to the first tubular member, from a first position to a second position;

a third tubular member defining a third internal passage, the third tubular member extending within the first internal passage, wherein the third tubular member is movable, relative to the first tubular member, from a third position to a fourth position;

a fourth tubular member coupled to the first tubular member, the fourth tubular member comprising an end portion that extends within the first internal passage; and a second annular region defined between the first and fourth tubular members and within which the third tubular member moves as the third tubular member moves from the third position to the fourth position; and wherein the first tubular member comprises a second flow port through which the second annular region is in fluid communication with the first annular region, the second flow port preventing hydraulic lock as the third tubular member moves from the third position to the fourth position.

25. The apparatus of claim 24, wherein the preexisting structure is a wellbore that traverses a subterranean formation.

26. The apparatus of claim 24, further comprising:

a first axially-extending channel formed in the outside surface of the second tubular member; and a first component extending from the first tubular member and into the first axially-extending channel, the first component resisting relative rotation between the first and second tubular members;

wherein, as the second tubular member moves from the first position to the second position, the first component guides the second tubular member while continuing to resist relative rotation between the first and second tubular members.

27. The apparatus of claim 26, further comprising:

a lock key at least partially disposed within the first axially-extending channel, the lock key comprising a bar member; and a spring radially disposed between the bar member and the second tubular member;

wherein, when the second tubular member is in the first position, the first component engages the bar member to thereby energize the spring; and wherein, when the second tubular member is in the second position:

the spring is sufficiently relaxed to radially position the lock key so that the first component is axially disposed between the lock key and a first surface of the second tubular member defined by the first axially-extending channel, and the first component resists any further relative movement between the first and second tubular members while continuing to resist relative rotation between the first and second tubular members.

28. The apparatus of claim 27, wherein the bar member defines first and second sides spaced in a parallel relation;

wherein the first component engages the first side of the bar member when the second tubular member is in the first position; and wherein the lock key further comprises:

first and second protrusions extending from the second side of the bar member at opposing end portions thereof; and an axially-extending region defined by the bar member and the first and second protrusions;

wherein the spring is at least partially disposed within the axially-extending region.

29. The apparatus of claim 28, wherein the spring comprises:

first and second end portions positioned between the first and second protrusions of the lock key, each of the first and second end portions being engaged with the second side of the bar member; and an arcuate portion disposed between the first and second end portions, the arcuate portion being engaged with a second surface of the second tubular member defined by the axially-extending channel.

30. The apparatus of claim 28, wherein the axially-extending channel includes a recess in which at least a portion of the spring is disposed.

31. The apparatus of claim 24, further comprising:

an opening formed in the outside surface of the second tubular member; and a first component comprising:

a body coupled to the first tubular member;

a shear portion extending from the body and into the opening; and a shoulder adjacent the proximal end of the shear portion, the shoulder defining a flat;

wherein, when the second tubular member is in the first position, the shear portion resists relative movement between the first and second tubular members; and wherein, as the second tubular member moves from the first position to the second position, the shear portion of the first component shears along a shear plane that is offset from, and generally parallel to, the flat defined by the shoulder.

32. The apparatus of claim 24, wherein the first flow port is blocked by the third tubular member when the second tubular member is in the first position and the third tubular member is in the third position;

wherein the first flow port is not blocked by the third tubular member when the second tubular member is in the first position and the third tubular member is in the fourth position; and wherein the first flow port is blocked by the second tubular member when the second tubular member is in the second position and the third tubular member is in the fourth position.

33. A method of forming an annular body of a fluidic material in a first annular region that is partially defined by a wellbore that traverses a subterranean formation, the method comprising:

providing an assembly comprising a first tubular member that defines a first internal passage;

extending a second tubular member within the first internal passage, the second tubular member forming part of the assembly;

positioning the assembly in the wellbore so that the outside surface of the first tubular member partially defines the first annular region;

moving the second tubular member, relative to the first tubular member, from a first position to a second position;

extending a third tubular member within the first internal passage before positioning the assembly in the wellbore, the third tubular member forming part of the assembly;

moving the third tubular member from a third position to a fourth position;

before positioning the assembly in the wellbore, extending a fourth tubular member within the first internal passage so that a second annular region is defined between the first and fourth tubular members, the fourth tubular member forming part of the assembly, wherein the third tubular member moves within the second annular region as the third tubular member moves from the third position to the fourth position; and preventing hydraulic lock as the third tubular member moves from the third position to the fourth position.

34. The method of claim 33, further comprising:

resisting relative rotation between the first and second tubular members.

35. The method of claim 34, further comprising:

during moving the second tubular member to the second position, guiding the second tubular member while continuing to resist relative rotation between the first and second tubular members.

36. The method of claim 35, further comprising:

after moving the second tubular member to the second position, locking the second tubular member by resisting any further relative movement between the first and second tubular members while continuing to resist relative rotation between the first and second tubular members.

37. The method of claim 33, further comprising:

resisting relative movement between the first and second tubular members when the second tubular member is in the first position.

38. The method of claim 37, further comprising:

removing the resistance to the relative movement between the first and second tubular members before the second tubular member has reached the second position.

39. The method of claim 33, further comprising:

resisting relative rotation between the first and third tubular members.

40. The method of claim 39, further comprising:

during moving the third tubular member from the third position to the fourth position, guiding the third tubular member while continuing to resist relative rotation between the first and third tubular members.

41. The method of claim 33, further comprising:

preventing the fluidic material from flowing from the first internal passage and into the first annular region when the second tubular member is in the first position and the third tubular member is in the third position;

permitting the fluidic material to flow from the first internal passage and into the first annular region when the second tubular member is in the first position and the third tubular member is in the fourth position; and preventing the fluidic material from flowing from the first internal passage and into the first annular region when the second tubular member is in the second position and the third tubular member is in the fourth position.

* * * * *